US008062821B2

(12) United States Patent
Yamamoto et al.

(10) Patent No.: US 8,062,821 B2
(45) Date of Patent: Nov. 22, 2011

(54) TONER, AND PROCESS CARTRIDGE AND IMAGE FORMING APPARATUS USING THE SAME

(75) Inventors: Atsushi Yamamoto, Kawanishi (JP); Chiyoshi Nozaki, Otsu (JP); Tsuyoshi Nozaki, Ikeda (JP)

(73) Assignee: Ricoh Company, Limited, Tokyo (JP)

( * ) Notice: Subject to any disclaimer, the term of this patent is extended or adjusted under 35 U.S.C. 154(b) by 36 days.

(21) Appl. No.: 12/398,541

(22) Filed: Mar. 5, 2009

(65) Prior Publication Data

US 2009/0232542 A1 Sep. 17, 2009

(30) Foreign Application Priority Data

Mar. 12, 2008 (JP) ..... 2008-063385

(51) Int. Cl.
*G03G 9/087* (2006.01)

(52) U.S. Cl. ..... 430/109.4; 430/109.1; 430/109.5

(58) Field of Classification Search ..... 430/109.1, 430/109.4, 109.5
See application file for complete search history.

(56) References Cited

U.S. PATENT DOCUMENTS

| | | | | |
|---|---|---|---|---|
| 7,384,720 | B2 * | 6/2008 | Tomita et al. | 430/108.4 |
| 7,709,174 | B2 * | 5/2010 | Sugimoto et al. | 430/110.2 |
| 2004/0157146 | A1 * | 8/2004 | Tomita et al. | 430/108.9 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2007/0026335 | A1 | 2/2007 | Yamamoto et al. | |
| 2007/0059625 | A1 | 3/2007 | Yamamoto et al. | |
| 2007/0141500 | A1 * | 6/2007 | Sugimoto et al. | 430/110.3 |
| 2007/0166635 | A1 | 7/2007 | Yamamoto et al. | |
| 2007/0190442 | A1 | 8/2007 | Nakamura et al. | |
| 2007/0207399 | A1 | 9/2007 | Kadota et al. | |
| 2007/0218384 | A1 | 9/2007 | Matsumoto et al. | |
| 2007/0218388 | A1 | 9/2007 | Kurose et al. | |
| 2007/0218393 | A1 | 9/2007 | Nozaki et al. | |
| 2007/0254224 | A1 * | 11/2007 | Sugino | 430/58.35 |
| 2008/0032223 | A1 | 2/2008 | Yamamoto et al. | |
| 2008/0069617 | A1 | 3/2008 | Matsumoto et al. | |
| 2008/0081273 | A1 | 4/2008 | Murakami et al. | |
| 2008/0131797 | A1 | 6/2008 | Ishikawa et al. | |
| 2008/0176159 | A1 | 7/2008 | Matsumoto et al. | |
| 2008/0232857 | A1 | 9/2008 | Matsumoto et al. | |

FOREIGN PATENT DOCUMENTS

| | | |
|---|---|---|
| JP | 2575127 | 10/1996 |
| JP | 2005-37429 | 2/2005 |
| JP | 3661422 | 4/2005 |
| JP | 2005-181835 | 7/2005 |
| JP | 2005-181839 | 7/2005 |
| JP | 2006-293304 | 10/2006 |
| JP | 4105650 | 4/2008 |
| JP | 2008-225410 | 9/2008 |

* cited by examiner

*Primary Examiner* — Hoa Le
(74) *Attorney, Agent, or Firm* — Oblon, Spivak, McClelland, Maier & Neustadt, L.L.P.

(57) ABSTRACT

A toner containing a binder resin including a unit of a polyester resin I having an amino group and another unit of a polyester resin II having an anion functional group and a coloring agent, wherein the toner is manufactured by dissolving or dispersing the polyester resin I, the polyester resin II and the coloring agent in an organic solvent to obtain an oil phase, dispersing the oil phase in an aqueous medium and removing the organic solvent followed by drying.

15 Claims, 3 Drawing Sheets

TONER, AND PROCESS CARTRIDGE AND IMAGE FORMING APPARATUS USING THE SAME

BACKGROUND OF THE INVENTION

1. Field of the Invention

The present invention relates to a toner, and a process cartridge and an image forming apparatus using the toner.

2. Discussion of the Background

Toner for use in forming images by electrophotography, etc. is typically a heat fusion powder in which a coloring agent is dispersed in a natural or synthetic resin. Therefore, the toner image transferred to a recording medium after development is fused and fixed thereon upon application of heat and pressure.

A heat roller system is widely used as the fixing system for use in dry development in terms of the energy efficiency. Recently, the heat energy provided to the toner during fixing has been decreasing by using a toner having a low temperature fixing property to save energy. Technology Procurement Project for the next generation photocopier was set in the DSM (demand-side Management) programs of IEA (International Energy Agency) in 1999. The requirement by the Project was published and it said that drastic energy saving should be achieved in comparison with typical photocopiers. To be specific, with regard to a photocopier having a speed of 30 cpm or higher, the waiting time is within 10 seconds and the consumption energy during stand-by is from 10 to 30 Watt (depending on the photocopying speed). Therefore, lowering the toner fixing temperature during actual use by lowering the fixing temperature of toner is considered to be an unavoidable technology to satisfy the requirement and minimize the waiting time. In an attempt to deal with the technology issue of lowering the fixing temperature of toner, a polyester resin has been used instead of a styrene acryl based resin, which has been diffused as a binder resin for toner, because the polyester resin has an excellent low temperature fixing property and mechanical strength while also having a relatively good high temperature preservability.

For example, unexamined published Japanese patent application No. (hereinafter referred to as JOP) 2002-351143 describes a technology in which toner particles are granulated by dissolving a polyester having an end modified by an isocyanate group and an unmodified polyester in an organic solvent to obtain an oil phase and adding a diamine compound when dispersing the oil phase in an aqueous dispersion to conduct isocyanate elongation reaction. In this method, mechanical strength is imparted to the toner by a cross-linked structure formed due to urea linkage of the isocyanate modified polyester. In addition, by designing the unmodified polyester to have a relatively low molecular weight, impregnation of toner on paper during fixing is accelerated, which leads to amelioration of the low temperature fixing property of the toner.

However, a single component toner formed of the toner manufactured as described above easily causes problems of production of abnormal images having streaks, uneven density, background fouling, etc. especially when images are continuously output because the toner particles tend to be insufficiently charged and crack or deform under the pressure by a toner regulation member, resulting in attachment of the toner to the toner regulation member or deterioration of chargeability. The mechanism of these problems is not clear but it is inferred that since the elongation agent such as the diamine compound to conduct elongation reaction has a high polarity, the elongation agent tends to detach into the aqueous phase or move to the interface between the oil phase and the aqueous phase. Therefore, the elongation reaction proceeds unevenly and insufficiently so that the toner does not have a strong mechanical strength. Furthermore, the elongation agent such as the diamine compound which tends to have a significant impact on the chargeability is present around the surface of the toner particles. Therefore, the toner is placed under mechanical stress, which deforms the toner surface. When the inside of such deformed toner is exposed, the toner is not uniformly charged because such deformed toner particles have different chargeability from other toner particles. This is another thinkable cause for the background fouling.

SUMMARY OF THE INVENTION

Because of these reasons, the present inventors recognize that a need exists for a toner having a good combination of low temperature fixability and mechanical strength to produce high definition images and a process cartridge and an image forming apparatus using such a toner.

Accordingly, an object of the present invention is to provide a toner having a good combination of low temperature fixability and mechanical strength to produce high definition images and a process cartridge and an image forming apparatus using such a toner.

Briefly this object and other objects of the present invention as hereinafter described will become more readily apparent and can be attained, either individually or in combination thereof, by a toner containing a binder resin including a unit of a polyester resin I having an amino group and another unit of a polyester resin II having an anion functional group, and a coloring agent. In addition, the toner is manufactured by dissolving or dispersing the polyester resin I, the polyester resin II and the coloring agent in an organic solvent to obtain an oil phase, dispersing the oil phase in an aqueous medium and removing the organic solvent followed by drying.

It is preferred that, in the toner described above, the polyester resin I is prepared by conducting reaction between a carboxylic residual group of a polyester and an amine compound.

It is still further preferred that, in the toner described above, the end of the polyester resin I is represented by the following Chemical structure 1 or 2:

$$—COX—Y_1—NR_1R_2 \qquad \text{Chemical structure 1}$$

where X represents oxygen atom or sulfur atom, $Y_1$ represents a divalent organic group, $R_1$ and $R_2$ each, independently, represent hydrogen atom or a hydrocarbon group having 1 to 8 carbon atoms, $$—CONR_3—Y_2—NR_4R_5 \qquad \text{Chemical structure 2}$$

where $Y_2$ represents a divalent organic group, $R_3$, $R_4$ and $R_5$ each, independently, represent hydrogen atom, or a hydrocarbon group having 1 to 8 carbon atoms.

It is still further preferred that, in the toner described above, the polyester resin I has an amine value of from 12 to 40 mgKOH/g and an acid value of from 0 to 2 mgKOH and the polyester resin II has an amine value of from 0 to 0.2 mgKOH/g and an acid value of from 15 to 40 mgKOH.

It is still further preferred that, in the toner described above, the polyester resin I and the polyester resin II have a weight average molecular weight of from 2,000 to 30,000.

It is still further preferred that, in the toner described above, the weight ratio of the polyester resin I to the polyester resin II ranges from 5:95 to 25:75.

It is still further preferred that, in the toner described above, the oil phase further contains a polyester resin III having an amine value of from 0 to 0.1 mgKOH/g, an acid value of from 0 to 2 mgKOH and a weight average molecular weight of from 2,000 to 20,000.

It is still further preferred that, in the toner described above, the toner is used as a single component development agent.

As another aspect of the present invention, a process cartridge detachably attachable to an image forming apparatus is provided which includes an image bearing member to bear a latent electrostatic image on the surface thereof, and a development device to develop the latent electrostatic image with the toner described above to obtain a visualized image. The development device includes a development agent container to accommodate a development agent containing the toner described above, a development agent bearing member to bear the development agent containing the toner described above on the surface thereof and supply the toner to the surface of the image bearing member, a development agent supply member to supply the development agent to the surface of the development agent bearing member, and a development agent regulation member to regulate the layer thickness of the toner described above on the development agent bearing member.

As another aspect of the present invention, an image forming apparatus is provided which includes an image bearing member to bear a latent electrostatic image on a surface thereof, a charging device to uniformly charge the surface of the image bearing member, an irradiation device to irradiate the image bearing member with light according to obtained image data and write the latent electrostatic image on the surface of the image bearing member, a development device to develop the latent electrostatic image with the toner described above to obtain a visualized image, a transfer device to transfer the visualized image to a recording medium and a fixing device to fix the visualized image on the recording medium. The development device includes a development agent container to accommodate a development agent containing the toner described above, a development agent bearing member to bear the development agent containing the toner described above on the surface thereof and supply the toner to the surface of the image bearing member, a development agent supply member to supply the development agent to the surface of the development agent bearing member, and a development agent regulation member to regulate the layer thickness of the toner described above on the development agent bearing member.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
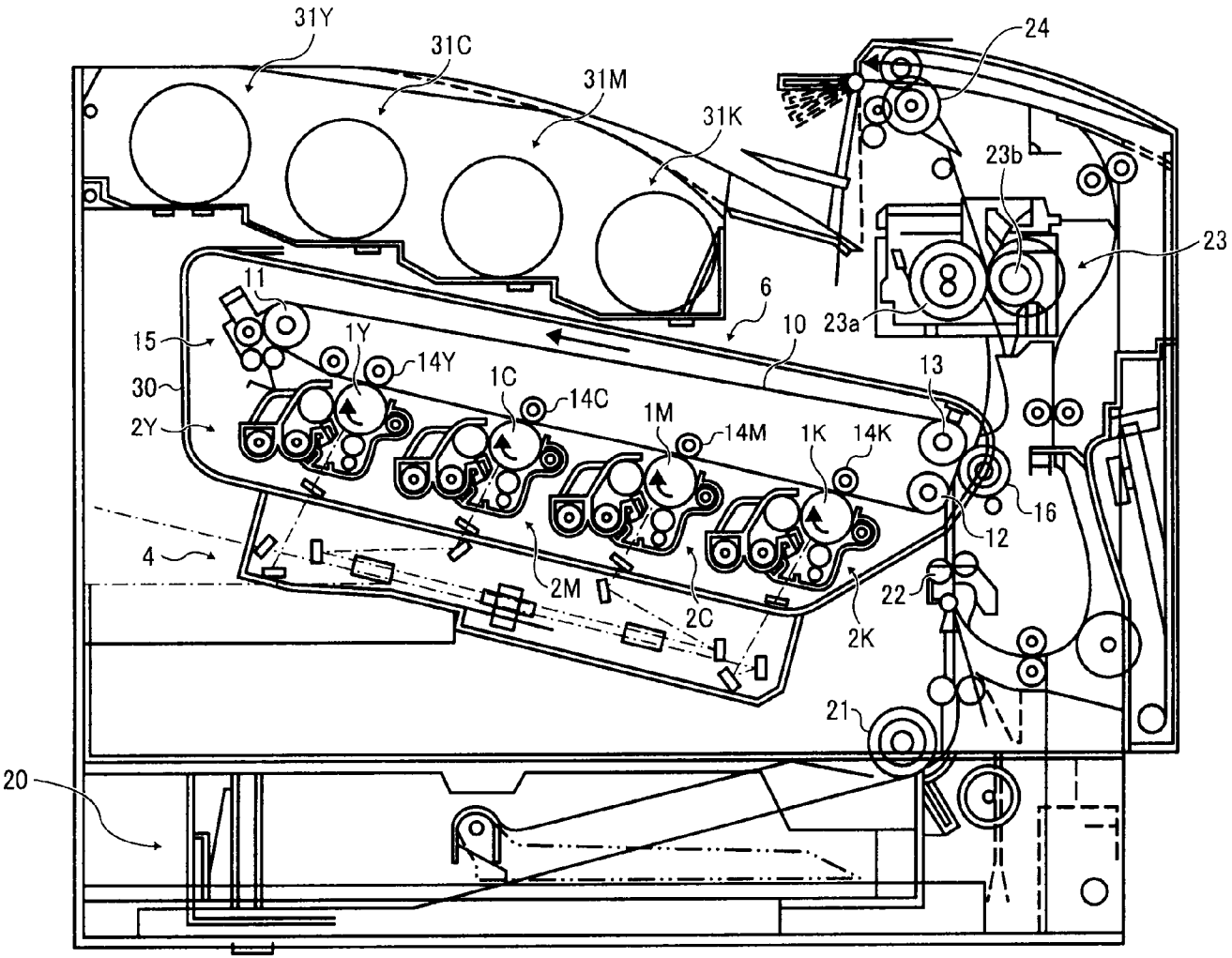
FIG. 1 is a schematic diagram illustrating a cross section of an example of the structure of the image forming apparatus of the present invention.

The toner, the process cartridge and the image forming apparatus of the present invention will be described below in detail with reference to several embodiments and accompanying drawings.

The toner of the present invention is obtained by dissolving or dispersing a polyester resin I having an amino group, a polyester resin II having an anion functional group and a coloring agent in an organic solvent to obtain an oil phase, dispersing the oil phase in an aqueous medium and removing the oil solvent followed by drying.

In general, to conduct reaction between polymers, the mobility of the polymers has a large impact on the reactivity thereof. For example, when the reaction between the polyester resin I having an amino group and the polyester resin II having an anion functional group conducted by melting and kneading is compared with the reaction between the two polymers conducted by mixing in a solvent, the mobility of the resins is higher in the case of mixing in a solvent so that ion bonding is formed in a relatively short time. As a result, the mechanical strength of the resins is extremely strong.

The toner of the present invention includes a binder resin including a unit of the polyester resin I and a unit of the polyester resin II and a coloring agent as its components.

The polyester resin I having an amino group preferably has a number of amino groups at the end of the polyester to efficiently form ion bonding. There is no specific limit to the method of introducing amino groups to the end of the polyester. For example, it is suitable to react an amine compound having a functional group reactive with a carboxylic acid residual group or an alcohol residual group of a polyester. Among these two methods, conducting reaction between an amine compound having a functional group reactive with a carboxylic acid residual group is preferred in terms of easiness of reaction.

The polyester resin typically used as the binder resin for toner can be used for the polyester portion of the polyester resin I. For example, the polycondensation products of the following polyol (1) and the polycarboxylic acid (2) are suitable.

Specific examples of the polyols (1) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F, bisphenol S and 4,4'-dihydroxybiphenyls such as 3,3'-difluoro-4,4'-dihydroxybiphenyl); bis(hydroxyphenyl) alkanes (e.g., bis(3-fluoro-4-hydroxyphenyl)ethane, 2,2-bis(3-fluoro-4-hydroxyphenyl)propane, 2,2-bis(3,5-difluoro-4-hydroxyphenyl)propane (aka tetrafluoro bisphenol A) and 2,2-bis(3-hydroxyphenyl)-1,1,1,3,3,3-hexafluoro propane; adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc.

Among these compounds, alkylene glycols having from 2 to 12 carbon atoms and adducts of a bisphenol with an alkylene oxide are preferable. More preferably, adducts of a bisphenol with an alkylene oxide, or a mixture of an adduct of a bisphenol with an alkylene oxide and an alkylene glycol having from 2 to 12 carbon atoms are used. Furthermore, aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc. can be included. The polyols specified above can be used alone or in combination.

Specific examples of the polycarboxylic acids (2) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids, 3-fluoroisophtalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethyl isophthalic acid, 2,2-bis(4-carboxyphenyl)hexafluoropropane, 2,2-bis(3-carboxyphenyl)hexafluoropropane, 2,2-bis(trifluoromethyl)-4,4'-biphenyl dicarboxylic acid, 3,3'-bis(trifluoromethyl-4,4'-biphenyl dicarboxylic acid, 2,2-bis(trifluoromethyl)-3,3'-biphenyl dicarboxylic acid, and an anhydride of hexafluoro isopropylidene diphthalic acid; etc.

Among these compounds, alkenylene dicarboxylic acids having 4 to 20 carbon atoms and aromatic dicarboxylic acids having 8 to 20 carbon atoms are preferably used.

Specific examples of the polycarboxylic acids having three or more hydroxyl groups include, but are not limited to, aromatic polycarboxylic acids having 9 to 20 carbon atoms (e.g., trimellitic acid and pyromellitic acid).

Also, resultants of reaction between an anhydride or lower alkyl esters (e.g., methyl esters, ethyl esters or isopropyl esters) of the polycarboxylic acids mentioned above and a polyol (1) can be used. These polycarboxylic acids specified above can be used alone or in combination.

A suitable mixing ratio (i.e., an equivalence ratio [OH]/[COOH]) of a polyol (1) to a polycarboxylic acid (2) is from 1/2 to 2/1, preferably from 1/1.5 to 1.5/1 and more preferably from 1/1.3 to 1.3/1.

There is no specific limit to the amine compounds reactive with the residual carboxylic acid group. Typical amine compounds are suitably used. Specific examples thereof include, but are not limited to, the compounds represented by the following Chemical formula 1 or 2.

$$R_1R_2N—Y_1—XH \qquad \text{Chemical formula 1}$$

$$R_4R_5N—Y_2—NHR_3 \qquad \text{Chemical formula 2}$$

In the Chemical formula 1, X represents oxygen atom or sulfur atom, $Y_1$ represents a divalent organic group, and $R_1$ and $R_2$ each, independently, represent hydrogen atom or a hydrocarbon group having 1 to 8 carbons and can share a ring with the nitrogen atom. The hydrocarbon group can be saturated or unsaturated and straight chained or branch-chained.

Specific examples of the compounds represented by Chemical formula 1 include, but are not limited to, aminoethanol, N-methyl-2-aminoethanol, N,N-dimethyl-2-aminoethanol, N-ethyl-2-aminoethanol, N,N-diethyl-2-aminoethanol, N-methyl-N-ethyl-2-aminoethanol, 3-amino-1-propanol, 3-methylamino-1-propanol, 3-dimethylamino-1-propanol, 1-dimethylamino-2-propanol, 3-diethylamino-1-propanol, 1-diethylamino-2-propanol, and 3-dimethylamino-2,2-dimethyl-1-propanol.

Among these, N,N-dimethyl-2-aminoethanol is preferred in terms of easiness of the reaction and the availability, When the compound represented by Chemical formula 1 reacts with the carboxyl group at the end of a polyester, as shown in the following chemical equation, XH group and the carboxyl group are dehydrated for esterification or thioesterification to produce the polyester resin I represented by the Chemical structure 1 having an amino group at its end.

$$\text{(Polymer)-COOH}+R_1R_2N—Y_1—XH \rightarrow \text{(Polymer)-COX}—Y_1—NR_1R_2\text{(Chemical structure 1)}+H_2O$$

When $R_1$ or $R_2$ of the compound represented by Chemical formula 1 is hydrogen atom, the amino group tends to react more easily than the XH group depending on compounds. As a result, a polyester having the XH group at its end may be produced. Thus, the obtained polyester and a polyester having an anion functional group do not have a mutual action with each other, meaning that the effect of the present invention does not demonstrate. $R_1$ and $R_2$ of the compound represented by Chemical formula 1 are preferably a saturated or unsaturated hydrocarbon group having 1 to 8 carbon atoms with a straight or branched chain and more preferably methyl group or ethyl group.

The compound represented by Chemical formula 2 has two amino groups and $Y_2$ represents a divalent organic group, $R_3$, $R_4$ and $R_5$ each, independently, represent hydrogen atom, or a hydrocarbon group having 1 to 8 carbon atoms. In addition, at least two of $R_3$, $Y_2$ and $R_5$ may link with a covalent bonding and share a ring with the nitrogen atom.

The two amino groups are preferably different from each other in terms of the reactivity. The size or the number of the substituent of the amino groups can be changed or the steric barrier difference around the amino groups can be used to make the two amino groups having different reactivity. When the two amino groups of the compound represented by Chemical formula 2 are equal or have the same reactivity, the amino group at the end of the obtained polyester conducts chain reaction with non-reacted carboxyl group. Therefore, the final polyester resin product has an extremely large molecular weight and in addition, a polyester having a high cross-linking density tends to be obtained especially when a polyester having a number of branches is used as the polyester to be reacted. As a result, the obtained polyester is hardly compatible with the polyester having an anion functional and the other polyesters so that the resultant toner does not have sufficient mechanical strength or the polyesters are not dissolved in an organic solvent in the next process, meaning that the toner is not manufactured. Therefore, the compound represented by Chemical formula 2 should be carefully selected and the steric barrier thereof should be controlled by the molecular skeleton. When the steric barrier is not controllable by the molecular skeleton, at least one of $R_4$ or $R_5$ is preferably methyl group or ethyl group and $R_3$ is hydrogen atom. Specific examples of the compounds represented by Chemical formula 2 include, but are not limited to, N-methyl ethylenediamine, N-ethyl ethylenediamine, N-isopropyl ethylenediamine, N-butyl ethylenediamine, N-hexyl ethylenediamine, N-octyl ethylenediamine, N,N-dimethyl ethylenediamine, N,N,N'-trimethyl ethylenediamine, N,N-diethyl-N'-methyl ethylenediamine, N,N,N'-triethyl ethylenediamine, N-methyl-1,3-diaminopropane, N-ethyl-1,3-diaminopropane, N-propyl-1,3-diaminopropane, N-butyl-1,3-diaminopropane, N-hexyl-1,3-diaminopropane, N-octyl-1,3-diaminopropane, 1-methyl piperazine, ethyl piperazine, and isophorone diamine.

Among these, isophorone diamine is preferable as the compound represented by Chemical formula 2 in terms of easiness of the reaction and the availability.

When the carboxyl group at the end of a polyester reacts with the compound represented by Chemical formula 2, an amide bonding is formed as a result of dehydration of the amino group and the carboxyl group as illustrated in the following chemical equation and the polyester resin I having an amino group represented by Chemical structure 2 is obtained.

$$\text{(Polymer)-COOH}+R_4R_5N—Y_2—NR_3H\rightarrow\text{(Polymer)-}CONR_3—Y_2—NR_4R_5\text{(Chemical Structure 2)}+H_2O$$

The polyester resin represented by Chemical structure 1 or 2 can be manufactured by conducting reaction in an inert gas atmosphere (for example, nitrogen gas) at 100 to 280° C., and preferably from 110 to 240° C. for 30 minutes or longer and preferably from 2 to 48 hours. A catalyst can be optionally used. Specific examples thereof include, but are not limited to, tin containing organic catalysts (for example, dibutyltin oxide), antimony trioxide, titanium containing catalysts (for example, titan alkoxide, potassium oxalic acid titanate, titanate terephthalate, catalysts described in JOP 2006-243715, catalysts described in 2007-11307, zirconium containing catalysts (for example, zirconyl acetate), zinc acetate, pyridine, 4-dimethylamino pyridine, dicyclohexylcarbodiimide and 1-hydroxydibenzo triazole. When this reaction is conducted in continuation with the polycondensation reaction, the reaction can be conducted without adding catalyst more unless the catalyst used in the polycondensation reaction is deactivated. However, a catalyst can be newly added to improve the reaction efficiency. The same catalyst as in the polycondensation reaction or a catalyst different therefrom can be added. The moisture produced during the reaction can be discharged from the system by reducing the pressure to ameliorate the reaction efficiency.

The weight average molecular weight of the polyester resin (I) having an amino group is not specifically limited but preferably from 2,000 to 30,000, more preferably from 4,000 to 15,000 and particularly preferably from 5,000 to 10,000. When the weight average molecular weight is too small, the polyester (I) tends to move into the aqueous medium so that the ion bonding formed with the carboxylic acid is not uniform, which results in insufficient mechanical strength of toner, or the toner chargeability after continuous printing in a single component development process is not uniform. To the contrary, when the weight average molecular weight is too large, the polyester (I) tends to be hardly soluble in an organic solvent so that the polyester (I) is unevenly present in the toner, which results in deterioration of toner mechanical strength and uneven chargeability.

The polycondensation products of the same polyol (1) as the polyester components of the polyester (I) specified above and the polycarboxylic acid (2) can be used as the polyester resin II having an anion functional group for use in the present invention. Preferred polyols and polyesters are the same as those specified for the polyester (I). A suitable mixing ratio (i.e., an equivalence ratio [OH]/[COOH]) of a polyol (1) to a polycarboxylic acid (2) is from 1/2 to 2/1, preferably from 1/1.5 to 1.5/1 and more preferably from 1/1.3 to 1.3/1.

Specific examples of the anion functional group of the polyester resin II having an anion functional group include, but are not limited to, carboxylic acid group at the end of the polyester, and a sulfonate group deriving from a polyol or a polycarboxylic acid having a sulfonate group.

The weight average molecular weight of the polyester resin II is not specifically limited but preferably from 2,000 to 30,000, more preferably from 4,000 to 15,000 and particularly preferably from 5,000 to 10,000. When the weight average molecular weight is too small, the low temperature fixing property tends to deteriorate.

When the polyester reins (I) and the polyester resin II are used, the amine value and the acid value of the polyester resin I are preferably from 12 to 40 mgKOH/g and from 0 to 2 mgKOH/g, respectively and the amine value and the acid value of the polyester resin II are preferably from 0 to 0.2 mgKOH/g and from 15 to 40 mgKOH/g, respectively. When the polyester resins (I) and (II) having amine values and acid values ranging outside the specified above, the ion bonding tends to be not sufficiently formed so that desired mechanical strength may not obtained.

The relationship between the polyester resin I and the polyester resin II with regard to the content is that one is larger than the other. The weight ratio of the less to the more is from 5/95 to 25/75, preferably from 8/92 to 25/75 and more preferably from 10/90 to 22/78.

When the content of the polyester resin I is close to the content of the polyester resin II, the toner tends to be hardly soluble, which results in deterioration of fixing power on paper. In addition, when the content of one of the two polyesters (I) and (II) is extremely small, the hot-offset durability easily deteriorates and in addition, obtaining a good combination of the high temperature preservability and the low temperature fixing property tends to be not easy.

The content of the polyester resin I can be set to be more than the content of the polyester resin II or the other way round. The content of the polyester resin II having an anion functional group is preferably set to be more to produce a toner having a negative chargeability and the content of the polyester resin I having an amino group is preferably set to be more to produce a toner having a positive chargeability in terms of chargeability control.

In the present invention, a polyester resin III having a low molecular weight, which does not substantially form ion bonding with the polyester resin I or the polyester resin II can be contained as the toner binder component in addition to the polyester resin I and the polyester resin II. By using the polyester (III) in combination, the offset durability on the low temperature side can be improved and high gloss images can be provided. The same polycondensation products of the polyol (1) and the polycarboxylic acid (2) as the polyester components of the polyester (I) and polyester (II) specified above can be used as the polyester resin III having an anion functional group for use in the present invention. Preferred polyols and polyesters are the same as those specified for the polyester (I) and the polyester (II). The polyester resin I, the polyester resin II and the polyester resin III are at least partially compatible with each other in terms of the low temperature fixing property and the hot offset durability. Therefore, the polyester component of the polyester resin I and the polyester resin II preferably has a structure similar to that of the polyester resin III.

The polyester resin III preferably has an amine value of from 0 to 0.1 mgKOH/g and an acid value of from 0 to 2 mgKOH/g. When the amine value and the acid value are outside these ranges, the polyester resin III easily reacts with the polyester resin I and/or the polyester resin II and thus does not exist as a low molecular weight component in the system. This means that the polyester resin III does not contribute to improvement of the offset durability or gloss property. The content of the polyester resin III is from 5 to 80 parts by weight, preferably from 10 to 65 parts by weight and more preferably from 15 to 50 parts by weight based on 100 parts of the total weight of the polyester resin I and the polyester resin II. When the content of the polyester resin III is too small, improvement on the offset property and the gloss property is hardly expected.

Suitable coloring agents (coloring material) for use in the toner of the present invention include known dyes and pigments. Specific examples of the coloring agents include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. The content of the coloring agent is from 1 to 15% by weight and preferably from 3 to 10% by weight based on the toner.

Master batch pigments, which are prepared by combining a coloring agent with a resin, can be used as the coloring agent of the toner composition of the present invention. Specific examples of the resins for use in the master batch pigments or for use in combination with master batch pigments include, but are not limited to, the modified polyester resins and the unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The master batch for use in the toner of the present invention is typically prepared by mixing and kneading a resin and a coloring agent for the master batch upon application of high shear stress thereto. In this case, an organic solvent can be used to boost the interaction of the coloring agent with the resin. In addition, flushing methods in which an aqueous paste including a coloring agent is mixed with a resin solution of an organic solvent to transfer the coloring agent to the resin solution and then the aqueous liquid and organic solvent are separated to be removed can be preferably used because the resultant wet cake of the coloring agent can be used without drying as it is. In this case, a high shear force dispersion device such as a three-roll mill can be preferably used to knead the mixture upon application of high shear stress thereto.

Additives such as a releasing agent (wax), a charge control agent and a resin particulate can be optionally added to the toner of the present invention.

Specific examples of the releasing agents include, but are not limited to, polyolefin waxes such as polyethylene waxes and polypropylene waxes; long chain hydrocarbons such as paraffin waxes and SAZOL waxes; waxes including a carbonyl group. Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; and dialkyl ketone such as distearyl ketone. Among these, in the present invention, a wax having a low polarity is suitably used. Specific examples thereof include, but are not limited to, hydrocarbon based wax such as polyethylene wax, polypropylene wax, paraffin wax, sazol wax, microcrystalline wax and Fisher-Tropsch wax.

The content of the releasing agent in the toner is from 2 to 5% by weight based on the total weight of the toner. When the content of the releasing agent is too small, the releasing agent is not effective to demonstrate the releasing property and no margin for protection from offset is secured. When the content of the releasing agent is too large, the releasing agent is easily affected by thermal energy and mechanical energy because the releasing agent tends to melt at a low temperature. Thus, the releasing agent easily oozes from the inside of the toner during stirring in the development device and attaches to the toner regulation applicator (blade) and the image bearing member, which may lead to the occurrence of the image noise. In addition, when printed on a transparent sheet, the releasing agent oozes outside the image area, which may cause image noise on a projected image. Furthermore, when the endothermic peak of the releasing agent measured by a differential scanning calorimeter (DSC) during temperature rising ranges preferably from 60 to 90° C., and more preferably from 65 to 80° C. When the endothermic peak is too low, the fluidity and the high temperature preservability tend to deteriorate. When the endothermic peak is too high, the fixing property tends to deteriorate.

Furthermore, the half width of the endothermic peak of the releasing agent measured by a differential scanning calorimeter (DSC) during temperature rising is preferably 8° C. or narrower, and preferably 6° or narrower. When the endothermic peak is too broad, the fluidity and the high temperature preservability tend to deteriorate.

Specific examples of the charge controlling agent include, but are not limited to, known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The method of manufacturing toner of the present invention is described below but is not limited thereto.

The method of manufacturing toner includes processes of dissolving or dispersing the polyester resin I having an amino group, the polyester resin II having an anion functional group and a coloring agent in an organic solvent to obtain an oil phase, dispersing the oil phase in an aqueous phase, and removing the solvent followed by drying.

The specific processes are as follows.

Organic Solvent

In the present invention, there is no specific limit to the selection of the organic solvent, as long as the organic solvent dissolves and/or disperses the toner component. A volatile organic solvent having a boiling point of 150° C. or lower is preferred because such an organic solvent is easy to remove. Specific examples of the organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methylethyl ketone, acetone, and tetrahydrofuran. These can be used singly or in combination. Among these, methyl acetate and ethyl acetate are preferable in terms that these have especially high volatility to the toner. The content of the solvent is from 40 to 300 parts by weight, preferably from 60 to 140 parts and more preferably from 80 to 120 parts by weight based on 100 parts of the toner solid component.

Aqueous Medium

Suitable aqueous medium to form an aqueous phase by dispersing resin particulates include water, and mixtures of water with a solvent which can be mixed with water. Specific examples of such a solvent include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc. These can be used alone or in combination.

Dispersion of Oil Phase

As described above, the toner particles are granulated by dissolving or dispersing the polyester resin I having an amino group, the polyester resin II having an anion functional group, a coloring agent in an organic solvent to obtain an oil phase and dispersing the oil phase in an aqueous medium to form ion bonding in the aqueous medium. A specific method of stably forming a liquid dispersion body formed of the polyester resin I and the polyester resin II in an aqueous medium is that the solution containing the polyester resin I and the polyester resin II is introduced into an aqueous medium and then the resultant is dispersed by shearing. The polyester resin I, the polyester resin II, a coloring agent, and other optional agents such as coloring agent master batch, a releasing agent, a charge control agent, and the polyester resin III, which are the toner component dispersed or dissolved in an organic solvent, can be mixed when the dispersion body is formed in an aqueous phase. However, it is preferred to preliminarily mix the toner component, adjust the oil phase in which the toner components are dissolved or dispersed in an organic solvent, and then add the oil phase to the aqueous medium for dispersion. In addition, the toner component such as the coloring agent, the releasing agent and the charge control agent are not necessarily mixed when particles are formed in the aqueous phase, but can be added after particles are formed. For example, a coloring agent can be added by a known dying method after particles including no coloring agent are formed.

There is no particular limit to the dispersion method. Low speed shearing methods, high speed shearing methods, friction methods, high pressure jet methods, ultrasonic methods, etc., can preferably be used. Among these methods, high speed shearing methods are more preferable because particles having a particle diameter of from 2 to 20 μm can be easily prepared. When a high speed shearing type dispersion machine is used, there is no particular limit to the rotation speed thereof, but the rotation speed is typically from 1,000 to 30,000 rpm, and preferably from 5,000 to 20,000 rpm. The dispersion time is not specifically limited but from 0.1 to 5 minutes in the case of the batch system. The temperature during dispersion is from 0 to 150° C. (under pressure) and preferably from 40 to 98° C. The content of the aqueous medium is from 50 to 2,000 parts by weight and preferably from 100 to 1,000 parts based on 100 parts of the solid portion contained in the organic solvent. When the content is too small, the toner composition tends to be badly dispersed so that toner particles having a predetermined particle diameter are not obtained. A content that is too large is not suitable in terms of economy.

A dispersion agent is optionally used. Using a dispersion agent is good to obtain a toner having a sharp particle size distribution and stabilize dispersion. Specific examples of such dispersion agents include, but are not limited to, a surface active agent, an inorganic particulate dispersion agent, and a polymer particulate dispersion agent.

Specific examples of the surface active agents include, but are not limited to, anionic dispersion agents, for example, alkylbenzene sulfonic acid salts, α-olefin sulfonic acid salts, and phosphoric acid salts; cationic dispersion agents, for example, amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersion agents, for example, fatty acid amide derivatives, polyhydric alcohol derivatives; and ampholytic dispersion agents, for example, alanine, dodecyldi(aminoethyl) glycin, di(octylaminoethyle)glycin, and N-alkyl-N,N-dimethylammonium betaine.

A surface active agent having a fluoroalkyl group is effective in an extremely small amount for a good dispersion. Preferred specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium 3-{omega-fluoroalkanoyl (C6-C8)-N-ethylamino}-1-propanesulfonate, fluoroalkyl (C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such anionic surface active agents having a fluoroalkyl group include, but are not limited to, SURFLON® S-111, S-112 and S-113, which are manufactured by Asahi Glass Co., Ltd.; FRORAR® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACES F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surface active agents having a fluoroalkyl group include, but are not limited to, primary, secondary and tertiary aliphatic amino acids, aliphatic quaternary ammonium salts (for example, perfluoroalkyl(C6-C10)sulfoneamidepropyltrimethyl ammonium salts), benzalkonium salts, benzethonium chloride, pyridinium salts, and imidazolinium salts.

Specific examples of the marketed products of such cationic surface active agents having a fluoroalkyl group include, but are not limited to, SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In addition, a water hardly soluble inorganic dispersing agents can be used. Specific examples thereof include, but are not limited to, tricalcium phosphate, calcium carbonate, titanium oxide, colloidal silica and hydroxyapatite.

Particulate polymers have been confirmed to have the same effect as an inorganic dispersing agent.

Specific examples of the particulate polymers include, but are not limited to, particulate polymethyl methacylate (MMA) having a particle diameter of 1 and 3 μm, particulate polystyrene having a particle diameter of 0.5 and 2 μm, particulate styrene-acrylonitrile copolymers having a particle diameter of 1 μm, etc. Specific examples of the marketed particulate polymers include, but are not limited to, PB-200H (available from Kao Corp.), SGP (available from Soken Chemical & Engineering Co., Ltd.), TECHNOPOLYMER® SB (available from Sekisui Plastics Co., Ltd.), SPG-3G (available from Soken Chemical & Engineering Co., Ltd.), MICROPEARL® (available from Sekisui Fine Chemical Co., Ltd.), etc.

Furthermore, it is possible to stably disperse toner components in an aqueous medium using a polymeric protection colloid in combinational use with the inorganic dispersing agents and particulate polymers mentioned above. Specific examples of such protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and homopolymers or copolymers having a nitrogen atom or an alicyclic ring having a nitrogen atom (e.g., vinyl pyridine, vinyl pyrrolidone, vinyl imidazole and ethylene imine).

In addition, polymers, for example, polyoxyethylene based compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protective colloid.

When compounds, for example, calcium phosphate, which are soluble in an acid or alkali, are used as a dispersion stabilizer, it is possible to dissolve the calcium phosphate by adding an acid, for example, hydrochloric acid, followed by washing of the resultant particles with water, to remove the calcium phosphate from particulates. In addition, a zymolytic method can be used to remove such compounds. Such a dispersion agent may remain on the surface of toner particles. However, it is preferred to wash and remove the dispersion agent in terms of the charging property of toner particles.

To remove the organic solvent from the obtained emulsified dispersion body, there can be used a method in which the entire system is gradually heated to completely evaporate and remove the organic solvent in droplets. Alternatively, a drying method can be used in which the dispersing body is sprayed in a dry atmosphere to completely evaporate and remove not only the non-water soluble organic solvent in droplets to form toner mother particles but also the remaining dispersing agent. The dry atmosphere can be prepared by heating gases, for example, air, nitrogen, carbon dioxide and combustion gases. The temperature of the heated gases is preferred to be higher than the boiling point of the solvent having the highest boiling point among the solvents used in the dispersion. By using a drying apparatus, for example, a spray dryer, a belt dryer, a rotary kiln, the drying treatment can be completed in a short period of time.

The time to be taken from mixing of the polyester resin I and the polyester resin II to removal of the organic solvent is 20 minutes or longer, preferably 60 minutes or longer, and more preferably 120 minutes or longer. When the solvent is removed in too short a time, the offset durability and the preservability tend to deteriorate.

In addition, the ion bonding is quickly and efficiently formed by heating the dispersion body, which leads to improvement on the offset durability during fixing. The dispersion body is heated from 30 to 90° C. and preferably from 35 to 80° C. When the dispersion body easily agglomerates by heating, a dispersion agent can be added.

When the particle size distribution during dispersion is wide and the washing and the drying are performed while keeping the wide particle size distribution, the particle size distribution is adjusted by classification to obtain a desired particle size distribution.

Particulate portions can be removed in the classification process by using a cyclone, a decanter, a centrifugal, etc. The classification can be performed when dried powder is obtained. However, classification in liquid is preferred in terms of the efficiency. Obtained unnecessary particulates or coarse particles can be returned to the mixing and the kneading process to granulate the toner particles. The obtained unnecessary particulates or coarse particles can be returned in the wet state.

The dispersion agent is preferably removed as much as possible and this removal is preferably performed together with the classification described above.

The obtained dry mother toner can be mixed with foreign particles such as releasing agent particulates, charge control particulates, fluidizer particulates and coloring agent particulates and these particulates can be fixed or fused on the surface of the mother toner by imparting the mechanical strength to the powder mixture, which prevents detachment of the foreign particles from the powder mixture.

Known inorganic particulates and particulate polymers can be preferably used as the external additives to reinforce the fluidity, developability and the chargeability of the obtained mother toner particles.

Specific examples of such inorganic particulate materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

In addition, particles of polymers such as polymers and copolymers of styrene, methacrylates, acrylates or the like; polymers prepared by polycondensation polymerization, such as silicone resins, benzoguanamine resins and nylon resins; and thermosetting resins, which can be prepared by a soap-free emulsion polymerization method, a suspension polymerization method or a dispersion polymerization method, can also be used as the external additive.

These materials for use as the external additive can be subjected to a surface treatment to be hydrophobized, thereby preventing the fluidity and charge properties of the toner even under high humidity conditions. Specific examples of the hydrophobizing agents include silane coupling agents, silylation agents, silane coupling agents including a fluoroalkyl group, organic titanate coupling agents, aluminum coupling agents, silicone oils, modified silicone oils, etc.

These external additives preferably have a primary particle diameter of from 5 nm to 2 μm, and more preferably from 5 nm to 500 nm. In addition, it is preferable that the specific surface area of such external additives measured by a BET method is from 20 to 500 $m^2/g$. The content of the external additives is preferably from 0.01 to 5% by weight, and more preferably from 0.01 to 2.0% by weight, based on total weight of the toner.

Specific examples of such mechanical impact application methods include, but are not limited to, methods in which a mixture is mixed with a high speed rotating blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner manufactured by the present invention can be used as a toner for use in a two component development agent containing a carrier. The carrier is mainly formed of, for example, glass, ferrite, nickel, zircon or silica. Powder having a particle diameter of from about 30 to about 1,000 μm or the powder used as a core material to which styrene-acryl resin, silicon resin, polyamide resin or polyfluorovinylidene resin is coated can be suitably selected as the carrier.

The image forming apparatus of the present invention includes an image bearing member to bear a latent electrostatic image, a charging device to uniformly charge the surface of the image bearing member, an irradiation device to irradiate the surface of the charged image bearing member according to the obtained image data with light to write the latent electrostatic image on the surface of the image bearing member, a development device to develop the latent electrostatic image formed on the surface of the image bearing member by supplying the toner thereto to obtain a visualized image, a transfer device to transfer the visualized image on the surface of the image bearing member to a transfer (recording) medium, and a fixing device to fix the visualized image on the recording medium. Also, the image forming apparatus optionally includes a discharging device, a cleaning device, a recycling device, a controlling device, etc.

The image formation method related to the present invention includes a charging process of uniformly charging the surface of an image bearing member, an irradiation process of irradiating the surface of the charged image bearing member with light according to the obtained image data and writing a latent electrostatic image on the surface of the image bearing member, a development process of developing the latent electrostatic image formed on the surface of the image bearing member via a development agent layer having a predetermined layer thickness regulated by a development agent regulation member to obtain a visualized image, a transfer process of transferring the visualized image on the surface of the image bearing member to a transfer (recording) medium, and a fixing process of fixing the visualized image on the transfer medium with optional processes such as a discharging process, a cleaning process, a recycling process, a control process, etc.

The latent electrostatic image is formed by uniformly charging the surface of the image bearing member by the charging device and irradiating the surface of the image bearing member with light according to the obtained image data by the irradiation device.

The visualized image formed in the development process is obtained by forming a toner layer on the development agent bearing member such as a development roller, and transferring the toner layer on the development agent bearing member such that the toner layer is in contact with the image bearing member such as a photoreceptor drum, thereby developing the latent electrostatic image on the image bearing member. The toner is stirred by a stirrer and mechanically supplied to a development agent supply member. The toner is supplied from the development agent supply member and accumulates on the development agent bearing member. While the accumulated toner passes the development agent layer regulation member provided to regulate the layer thickness of the toner, the toner is charged and forms a uniform thin layer. Then, the latent electrostatic image formed on the image bearing member is developed with toner by the development device when the charged toner is attached to the surface of the image bearing member in the development area.

The visualized (toner) image is transferred by, for example, charging the image bearing member by a transfer charging device of the transfer device.

The transferred toner image is fixed by fixing the transferred image on the recording medium by the fixing device. Fixing can be performed every time a color toner image is transferred to the recording medium, or at one time when each color toner is accumulated atop.

There is no specific limit to the fixing device and known heating and pressure device can be suitably used. A combination of a heating roller and a pressure roller or a combination of a heating roller, a pressure roller and an endless belt can be used as the heating pressure device. The heating pressure roller is preferably heated to from 80 to 200° C.

The basic structure of the image forming apparatus (printer) related to an embodiment of the present invention is described with reference to the accompany drawings. FIG. 1 is a schematic diagram illustrating the structure of the image forming apparatus as an embodiment of the present invention.

The image forming apparatus illustrated in FIG. 1 is to form color images of 4 color toners of yellow (Y), cyan (C), magenta (M) and black (K).

The image forming apparatus (tandem type) includes multiple image bearing members arranged along the moving direction of a surface moving member. The image forming apparatus has four image bearing members 1Y, 1C, 1M and 1K. In FIG. 1, the image bearing members have a drum form but can employ another form such as a belt form. Each image bearing member 1Y, 1C, 1M and 1K rotates in the direction indicated by an arrow while in contact with an intermediate transfer belt 10 functioning as the surface moving member. Each image bearing member 1Y, 1M, 1C and 1K has an electroconductive substrate having a thin cylindrical form on which a photosensitive layer and a protective layer are accumulated in this sequence. An intermediate layer can be formed between the photosensitive layer and the protective layer.

Figure 2:
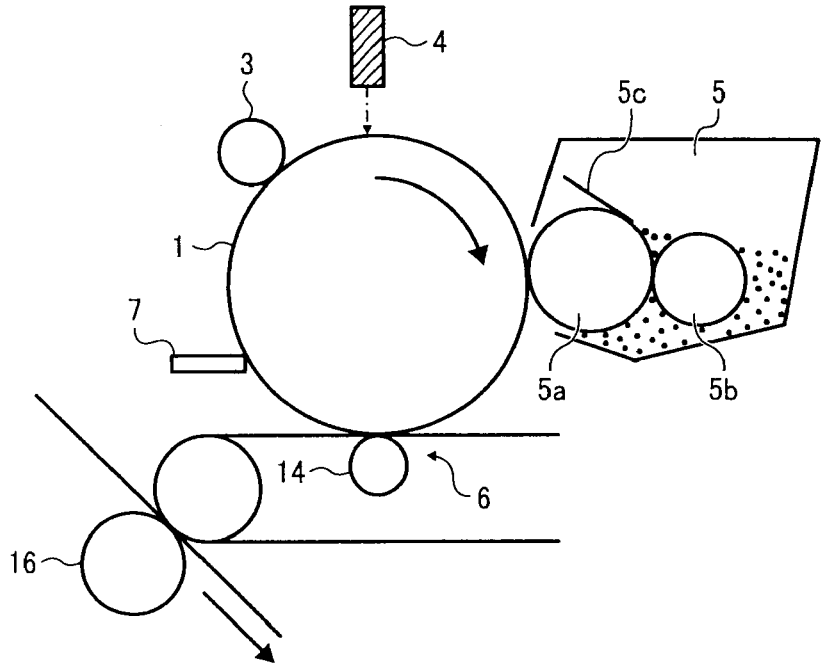
FIG. 2 is a schematic diagram illustrating a cross section of an example of the image formation portion having an image bearing member.

FIG. 2 is a schematic diagram illustrating the structure of an image formation portion 2 (2Y, 2M, 2C and 2K) illustrated in FIG. 1. Since the structure around each image bearing member 1Y, 1M, 1C and 1K of the image formation portion 2Y, 2M, 2C and 2K are the same, only one of the four is illustrated and the numeral references Y, C, M and K are omitted in FIG. 2. A charging device 3, a development device 5, a transfer device 6 which transfers the toner image on the image bearing member 1 to a recording medium or an intermediate transfer body 10, and a cleaning device 7 which removes untransferred toner remaining on the image bearing member 1 are arranged in this sequence around the image bearing member 1 along the surface moving direction thereof. A space is secured between the charging device 3 and the development device 5 so that the light emitted from the irradiation device 4 which writes a latent electrostatic image on the image bearing member 1 can reach the image bearing member 1 through the space.

The charging device 3 negatively charges the surface of the image bearing member 1. The charging device 3 in this embodiment has a charging roller of the contact or the vicinity type which performs charging. That is, the charging roller 3 has a charging roller situated in contact with or in the vicinity of the surface of the image bearing member 1 and applies a negative bias to the charging roller to charge the surface of the image bearing member 1. A DC charging bias is applied to the charging roller such that the surface voltage of the image bearing member 1 is −500 V.

A bias in which an AC bias is overlapped with a DC bias can be used as the charging bias. In addition, a cleaning brush can be provided to the charging device 3 to clean the surface of the charging roller. Furthermore, a thin film can be rolled around the surface of the both ends of the charging roller relating to the axis direction and this charging device 3 can be arranged in contact with the surface of the image bearing member 1 at the both ends of the charging roller. In this structure, there is an extremely small gap corresponding to the thickness of the film between the surface of the charging roller and the surface of the image bearing member 1. Therefore, discharging occurs between the surface of the image bearing member 1 and the surface of the charging roller, which charges the surface of the image bearing member 1.

The thus charged surface of the image bearing member 1 is irradiated by the irradiation device 4 and then a latent electrostatic image corresponding to each color is formed on the surface of the image bearing member 1. The irradiation device 4 writes a latent electrostatic image corresponding to each color on the image bearing member according to the obtained image data corresponding to each color. The irradiation device 4 has a laser system but can employ another system formed of an LED array and a focusing device.

The toner replenished from toner bottles 31Y, 31C, 31M and 31K to the development device 5 is transferred by a supply roller 5*b* and borne on the development roller 5*a*. The toner borne on this development roller 5*a* is transferred to the development area opposing the image bearing member 1. The surface of the development roller 5*a* moves faster than the surface of the image bearing member 1 in the development area opposing the image bearing member 1 with regard to the linear velocity. At this point of time, a development bias of −300 V is applied to the development roller 5*a* by a power supply (not shown) so that a development electric field is formed in the development area. Thereby, an electrostatic force is applied to the toner on the development roller 5 toward the image bearing member 1. Therefore, the toner on the development roller 5*a* moves and attaches to the latent electrostatic image on the surface of the image bearing member 1 while the development roller abrades the surface of the image bearing member 1. Thus, the latent electrostatic image on the image bearing member 1 is developed by the respective color toners.

The intermediate transfer body (belt) 10 in the transfer device 6 is suspended over three support rollers 11, 12 and 13 and moves endlessly along the direction indicated by an arrow in FIG. 1. The toner images on each image bearing member 1Y, 1M, 1C and 1K are transferred to the intermediate transfer belt 10 atop by the electrostatic system. Although there is an electrostatic system having a transfer charger, a transfer roller 14 is employed in this embodiment to reduce production of transfer dust. Specifically, primary transfer rollers 14Y, 14C, 14M and 14K functioning as the transfer device 6 are provided on the rear surface portion of the intermediate transfer belt 10 while contacting with respective image bearing members 1Y, 1C, 1M and 1K. The portions of the intermediate transfer belt 10 pressed by respective primary transfer rollers 14Y, 14M, 14C and 14*k* and corresponding image bearing members 1Y, 1M, 1C and 1K form primary transfer nip portions where the intermediate transfer belt 10 is nipped by the image bearing members 1 and the primary transfer rollers 14. A positive bias is applied to the respective primary transfer rollers 14 when the toner images on the image bearing members 1Y, 1M, 1C and 1K are transferred to the intermediate transfer belt 10. Thereby, a transfer electric field is formed on the respective primary transfer nip portions so that the toner images on the image bearing members 1Y, 1M, 1C and 1K are electrostatically transferred to and attached to the intermediate transfer belt 10.

Around the intermediate transfer belt 10, a belt cleaning device 15 is provided to remove residual toner remaining on the surface of the intermediate transfer belt 10. This belt cleaning device 15 has a structure which collects toner attached to and remaining on the surface of the intermediate transfer belt 10 by a fur brush and a cleaning blade. The collected toner is transferred to a waste toner tank (not shown) by a transfer device (not shown) from the inside of the belt cleaning device 15.

In addition, a secondary transfer roller 16 is provided in contact with the portion of the intermediate transfer belt 10 suspended over the support roller 13. The intermediate transfer belt 10 and the secondary transfer roller 16 form a secondary transfer nip portion where a recording medium is nipped. The recording medium (transfer paper) is fed in a synchronized timing. This recording medium is accommodated in a paper feeder cassette 20 situated below the irradiation device 4 and transferred to the secondary transfer nip portion by a paper feeder roller 21, a pair of registration rollers 22, etc. The toner image overlapped on the intermediate transfer belt 10 is transferred to the recording medium at the secondary transfer nip portion at one time. During this secondary transfer, a positive bias is applied to the secondary transfer roller 16 to form a transfer electric field, thereby transferring the toner image on the intermediate transfer belt 10 to the recording medium.

On the downstream side of the secondary transfer nip portion related to the recording medium transfer direction, a heat fixing device 23 is provided. This heat fixing device 23 has a heating roller 23*a* and a pressure roller 23*b*. The recording medium that has passed through the secondary nip portion is nipped between these rollers and heated and pressed. Thereby, the toner on the recording medium is melted and the toner image is fixed on the recording medium. The recording medium after fixing is discharged by a discharging roller 24 to a discharging tray situated on the top side of the main body of the image forming apparatus.

Figure 3:
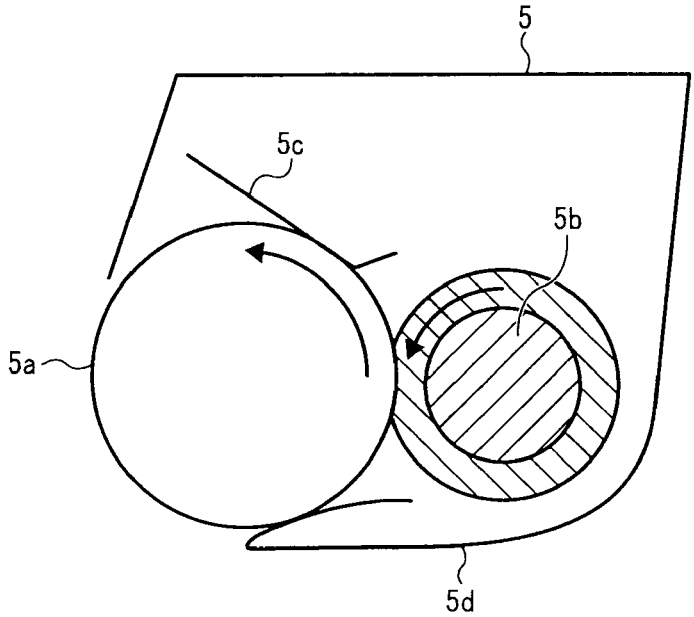
FIG. 3 is a schematic diagram illustrating a cross section of an example of the structure of the development device for use in the present invention.

As illustrated in FIGS. 2 and 3, the development roller 5*a* of the development device 5 partially extrudes from an opening of the casing thereof. A single component development agent including no carrier is used in this embodiment. Corresponding color toners are supplied from the toner bottles 31Y, 31M, 31C and 31K illustrated in FIG. 1 and accommodated in the development device 5. Each of these toner bottles 31Y, 31M, 31C and 31K is detachably attachable to the image forming apparatus so that any one of them is replaceable. Thus, when the toner is depleted in one of the toner bottles 31, only that toner bottle is necessary to be replaced while the other members still having a working life is left undone, which leads to cost saving.

FIG. 3 is a schematic diagram illustrating the structure of the development device 5.

While the development agent (toner) accommodated in the development agent container is stirred in the supply roller 5*b* as the development agent supply member, the development agent to be transferred to the image bearing 1 is transferred to the nip portion of the development roller 5*a* functioning as the development agent bearing member that bears the development agent on the surface. The supply roller 5*b* and the development roller 5*a* rotate in a counter manner. Furthermore, a regulation blade 5*c* functioning as the development agent regulation member provided in contact with the development roller 5*a* regulates the amount of the toner on the development roller 5*a* to form a thin toner layer thereon. In addition, the toner is abraded at the nip portion between the supply roller 5*b* and the development roller 5*a* and between the regulation blade 5*c* and the development roller 5*a*, which controls the amount of charge of the toner.

Figure 4:
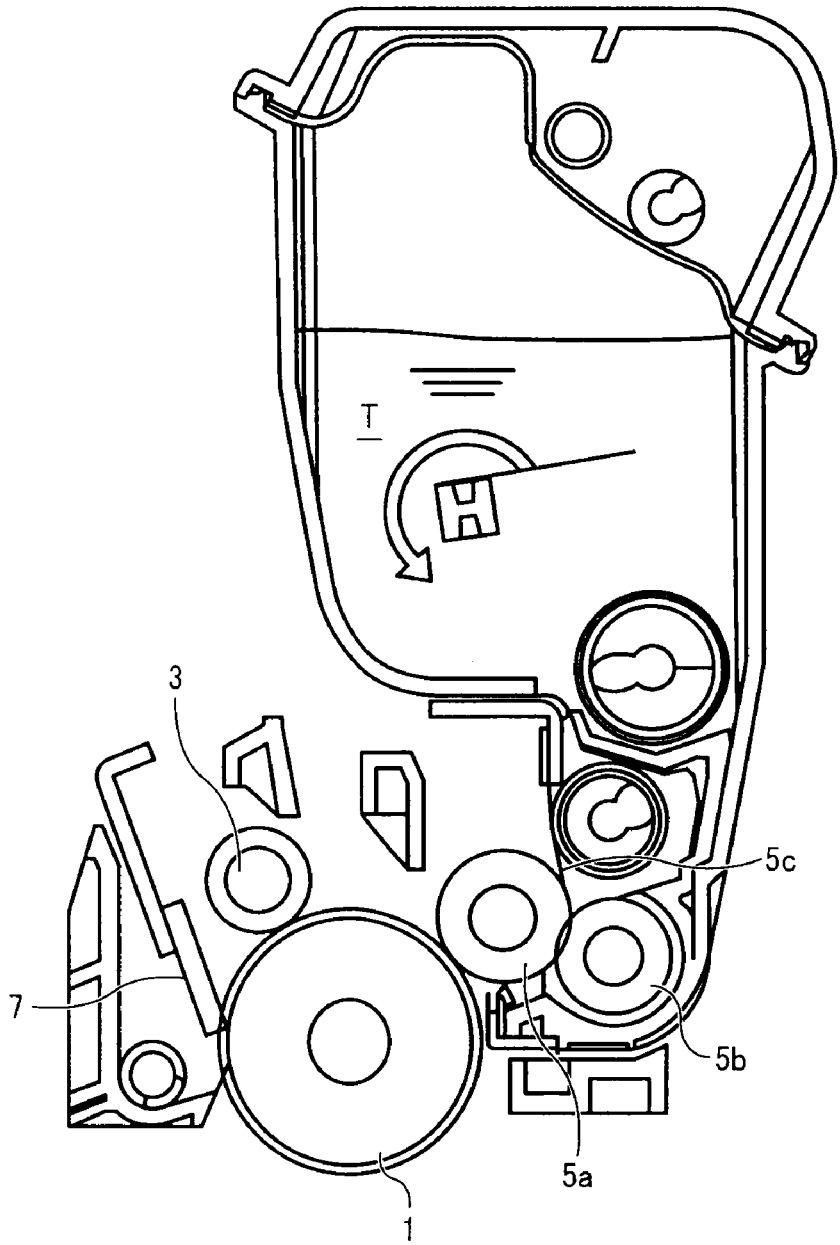
FIG. 4 is a schematic diagram illustrating a cross section of an example of the structure of the process cartridge of the present invention.

FIG. 4 is a schematic diagram illustrating an example of the structure of the process cartridge of the present invention.

The development agent (toner) of the present invention can be used for, for example, an image forming apparatus having the process cartridge as illustrated in FIG. 4. In the present invention, an image bearing member and at least one of a charging device, a development device, a cleaning device, etc. are integrally structured as a process cartridge and the process cartridge is detachably attachable to an image forming apparatus such as a photocopier or a printer.

The process cartridge illustrated in FIG. 4 includes the image bearing member 1, the charging device 3 and the development device 5 illustrated in FIG. 3.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following description, the polyester resin I having an amino group is represented by "polyester 1a, 1b, 1c or 1d having an amino group", the polyester resin II having an anion functional group is represented by "polyester 2a, 2b, 2c or 2d having an anion functional group" and the polyester resin III is represented by "polyester 3a or 3b".

Synthesis of Polyester 1a Having Amino Group

The following components are placed in a reaction container equipped with a condenser, a stirrer and a nitrogen introducing tube to conduct a reaction at 210° C. for 8 hours followed by another reaction with a reduced pressure of 5 to 20 mmHg for 4 hours:

| | |
|---|---|
| Adduct of bisphenol A with 2 mol of ethylene oxide | 130 parts |
| Adduct of bisphenol A with 2 mol of propylene oxide | 533 parts |
| Terephthalic acid | 192 parts |
| Adipic acid | 10 parts |
| Trimellitic anhydride | 48 parts |
| Dodecenyl succinic anhydride | 155 parts |
| Dibutyl tin oxide | 3 parts |

60 parts of N,N-dimethyl-2-aminoethanol is added in the container to conduct a reaction at 120° C. under normal pressure for 24 hours to obtain [Polyester 1a having an amino group].

The obtained [Polyester 1a having an amino group] has a weight average molecular weight of 8,500, an acid value of 0.6 mgKOH/g, and an amine value of 35.4 mgKOH/g.

Synthesis of Polyester 1b Having Amino Group

The following components are placed in a reaction container equipped with a condenser, a stirrer and a nitrogen introducing tube to conduct a reaction at 220° C. for 6 hours followed by another reaction with a reduced pressure of 10 to 15 mmHg for 3 hours:

| | |
|---|---|
| Adduct of bisphenol A with 2 mol of ethylene oxide | 363 parts |
| Terephthalic acid | 12 parts |
| Isophthalic acid | 164 parts |
| Dibutyl tin oxide | 2 parts |

14 parts of N,N-dimethyl-2-aminoethanol is added in the container to conduct a reaction at 120° C. under normal pressure for 24 hours to obtain [Polyester 1b having an amino group].

The obtained [Polyester 1b having an amino group] has a weight average molecular weight of 6,300, an acid value of 0.4 mgKOH/g, and an amine value of 16.3 mgKOH/g.

Synthesis of Polyester 1c Having Amino Group

The following components are placed in a reaction container equipped with a condenser, a stirrer and a nitrogen introducing tube to conduct a reaction at 230° C. for 10 hours followed by another reaction with a reduced pressure of 10 to 15 mmHg for 6 hours:

| | |
|---|---|
| Adduct of bisphenol A with 2 mol of ethylene oxide | 224 parts |
| Adduct of bisphenol A with 2 mol of propylene oxide | 224 parts |
| Terephthalic acid | 176 parts |
| Adipic acid | 50 parts |
| Dibutyl tin oxide | 2 parts |

17 parts of N,N-dimethyl-2-aminoethanol is added in the container to conduct a reaction at 120° C. under normal pressure for 24 hours to obtain [Polyester 1c having an amino group].

The obtained [Polyester 1c having an amino group] has a weight average molecular weight of 21,000, an acid value of 1.8 mgKOH/g, and an amine value of 15.9 mgKOH/g.

Synthesis of Polyester 1d Having Amino Group

The following components are placed in a reaction container equipped with a condenser, a stirrer and a nitrogen introducing tube to conduct a reaction at 210° C. for 8 hours followed by another reaction with a reduced pressure of 5 to 20 mmHg for 4 hours:

| | |
|---|---|
| Adduct of bisphenol A with 2 mol of ethylene oxide | 228 parts |
| Adduct of bisphenol A with 2 mol of propylene oxide | 435 parts |
| Terephthalic acid | 192 parts |
| Isophthalic acid | 110 parts |
| Adipic acid | 10 parts |
| Trimellitic anhydride | 48 parts |
| Dibutyl tin oxide | 3 parts |

75 parts of isophorone diamine is added in the container to conduct a reaction at 120° C. under normal pressure for 1.5 hours to obtain [Polyester 1d having an amino group].

The obtained [Polyester 1d having an amino group] has a weight average molecular weight of 8,300, an acid value of 1.3 mgKOH/g, and an amine value of 24.2 mgKOH/g.

Synthesis of Vinyl Resin Having Amino Group 510 parts of toluene are placed in a reaction container equipped with a condenser, a stirrer and a nitrogen introducing tube and the air in the reaction container is replaced with nitrogen gas. 540 parts of styrene, 105 parts of n-butylacrylate, 36 parts of N-(3-dimethylaminopropyl)acrylamide and 5 parts of benzoyl peroxide as a polymerization initiator are dissolved to obtain a solvent mixture while stirred under reflux of the toluene and the solvent mixture is dropped to the reaction container in 2.5 hours. Thereafter, the resultant is stirred and aged for one hour at a temperature at which the toluene evaporates to conduct solution polymerization. Thereafter, the temperature of the system is gradually raised to 180° C. and the toluene is removed under a reduced pressure to obtain a polymerization body. The polymerization body is cooled down and pulverized to obtain [Vinyl resin having an amino group]. The obtained [Vinyl resin having an amino group] has a weight average molecular weight of 18,000, an acid value of 0.2 mgKOH/g, and an amine value of 19.0 mgKOH/g.

Synthesis of Polyester 2a Having Anion Functional Group

The following components are placed in a reaction container equipped with a condenser, a stirrer and a nitrogen introducing tube to conduct a reaction at 230° C. for 8 hours followed by another reaction with a reduced pressure of 10 to 15 mmHg for 5 hours:

| | |
|---|---|
| Adduct of bisphenol A with 2 mol of ethylene oxide | 229 parts |
| Adduct of bisphenol A with 2 mol of propylene oxide | 529 parts |
| Terephthalic acid | 208 parts |
| Adipic acid | 46 parts |
| Dibutyl tin oxide | 2 parts |

44 parts of trimellitic anhydride is added in the container to conduct a reaction at 180° C. under normal pressure for 2 hours to synthesize [Polyester 2a having an anion functional group].

The obtained [Polyester 2a having an anion functional group] has a number average molecular weight of 2,500, a weight average molecular weight of 6,700, an acid value of 25 mgKOH/g, and an amine value of 0.1 mgKOH/g or less.

Synthesis of Polyester 2b Having Anion Functional Group

The following components are placed in a reaction container equipped with a condenser, a stirrer and a nitrogen introducing tube to conduct a reaction at 220° C. for 8 hours followed by another reaction with a reduced pressure of 10 to 15 mmHg for 5 hours to synthesize [Polyester 2b having an anion functional group]:

| | |
|---|---|
| Adduct of bisphenol A with 2 mol of ethylene oxide | 270 parts |
| Adduct of bisphenol A with 2 mol of propylene oxide | 230 parts |
| Terephthalic acid | 148 parts |
| Isophthalic acid | 148 parts |
| Adipic acid | 20 parts |
| Dimethyl isophthalate-5-sodium sulfonate | 14 parts |
| Dibutyl tin oxide | 2 parts |

The obtained [Polyester 2b having an anion functional group] has a weight average molecular weight of 7,300, an acid value of 21 mgKOH/g, and an amine value of 0.1 mgKOH/g or less.

Synthesis of Polyester 2c Having Anion Functional Group

The following components are placed in a reaction container equipped with a condenser, a stirrer and a nitrogen introducing tube to conduct a reaction at 170° C. for 5 hours followed by another reaction with a reduced pressure of 10 to 15 mmHg for 220 hours to synthesize [Polyester 2c having an anion functional group]:

| | |
|---|---|
| Dipropylene glycol | 89 parts |
| Neopentyl glycol | 80 parts |
| Terephthalic acid | 93 parts |
| Isophthalic acid | 93 parts |
| Adipic acid | 5 parts |
| Dimethyl isophthalate-5-sodium sulfonate | 8.2 parts |
| Dibutyl tin oxide | 0.1 parts |

The obtained [Polyester 2c having an anion functional group] has a weight average molecular weight of 5,800, an acid value of 17 mgKOH/g, and an amine value of 0.1 mgKOH/g or less.

Synthesis of Polyester 2d Having Anion Functional Group

The following components are placed in a reaction container equipped with a condenser, a stirrer and a nitrogen introducing tube to conduct a reaction at 230° C. for 8 hours followed by another reaction with a reduced pressure of 10 to 15 mmHg for 5 hours:

| | |
|---|---|
| Adduct of bisphenol A with 2 mol of ethylene oxide | 190 parts |
| Adduct of bisphenol A with 2 mol of propylene oxide | 485 parts |
| Terephthalic acid | 215 parts |
| Isophthalic acid | 50 parts |
| Adipic acid | 51 parts |
| Dibutyl tin oxide | 2 parts |

28 parts of trimellitic anhydride is added in the container to conduct a reaction at 180° C. under normal pressure for 2 hours to synthesize [Polyester 2d having an anion functional group].

The obtained [Polyester 2a having an anion functional group] has a number average molecular weight of 7,100, a weight average molecular weight of 19,000, an acid value of 20.4 mgKOH/g, and an amine value of 0.1 mgKOH/g or less.

Synthesis of Vinyl Resin Having Anion Functional Group 510 parts of toluene are placed in a reaction container equipped with a condenser, a stirrer and a nitrogen introducing tube and the air in the reaction container is replaced with nitrogen gas. 545 parts of styrene, 148 parts of n-butylacrylate, 41 parts of methacrylic acid and 5 parts of benzoyl peroxide as a polymerization initiator are dissolved to obtain a solvent mixture while stirred under reflux of the toluene and the solvent mixture is dropped to the container in 2.5 hours. Thereafter, the resultant is stirred and aged for one hour at a temperature at which the toluene evaporates to conduct solution polymerization. Thereafter, while the temperature of the system is gradually raised to 180° C., the toluene is removed under a reduced pressure to obtain a polymerization body. The polymerization body is cooled down and pulverized to obtain [Vinyl resin having an anion functional group]. The obtained [Vinyl resin having an anion functional group] has a weight average molecular weight of 16,000, an acid value of 36 mgKOH/g, and an amine value of 0.1 mgKOH/g or less.

Synthesis of Polyester 3a

The following components are placed in a reaction container equipped with a condenser, a stirrer and a nitrogen introducing tube to conduct a reaction at 230° C. for 6 hours followed by another reaction with a reduced pressure of 10 to 15 mmHg for 230 hours to synthesize [Polyester 3a]:

| | |
|---|---|
| Adduct of bisphenol A with 2 mol of ethylene oxide | 654 parts |
| Dimethyl terephthalate | 389 parts |
| Dimethyl isophthalate | 126 parts |
| Dibutyl tin oxide | 0.1 parts |

The obtained [Polyester 3a] has a weight average molecular weight of 5,100, an acid value of 0.2 mgKOH/g, and an amine value of 0.1 mgKOH/g or less.

Synthesis of Polyester 3b

The following components are placed in a reaction container equipped with a condenser, a stirrer and a nitrogen introducing tube to conduct a reaction at 210° C. for 8 hours followed by another reaction with a reduced pressure of 5 to 20 mmHg for 4 hours:

| | |
|---|---|
| Adduct of bisphenol A with 2 mol of ethylene oxide | 130 parts |
| Adduct of bisphenol A with 2 mol of propylene oxide | 533 parts |
| Terephthalic acid | 192 parts |
| Adipic acid | 10 parts |
| Trimellitic anhydride | 48 parts |
| Dodecenyl succinic anhydride | 155 parts |
| Dibutyl tin oxide | 3 parts |

210 parts of dimethylamino propylamide stearate is added in the container to conduct a reaction at 120° C. under normal pressure for 3 hours to synthesize [Polyester 3b].

The obtained [Polyester 3b] has a weight average molecular weight of 8,500, an acid value of 33 mgKOH/g, and an amine value of 30 mgKOH/g.

Synthesis of Master Batch

The following is mixed by a HENSCHEL MIXER to obtain a mixture in which water is soaked in a pigment agglomeration body.

| | |
|---|---|
| Carbon black (REGUL 400R, manufactured by Cabot Corporation) | 40 parts |
| [Polyester 2a having an anion functional group] | 60 parts |
| Water | 30 parts |

The mixture is mixed and kneaded for 45 minutes by a two-roll with the surface temperature of the rolls at 130° C. The resultant is pulverized by a pulverizer to a size of about 1 mmΦ to obtain [Master batch 1].

Example 1

Manufacturing of Liquid Dispersion of Pigment and Releasing Agent

The following is placed and mixed in a reaction container equipped with a stirrer and a thermometer:

| | |
|---|---|
| [Polyester 2a having an anion functional group] | 545 parts |
| Paraffin wax | 181 parts |
| Ethyl acetate | 1,450 parts |

The mixture is agitated, heated to 80° C., and kept at 80° C. for 5 hours and then cooled down to 30° C. in 1 hour. Then, 350 parts of [Master batch 1] and 100 parts of ethyl acetate are added in the reaction container and mixed for 1 hour to obtain [Liquid material 1].

Then, 1,500 parts of [Liquid material 1] is transferred to a reaction container and dispersed using a bead mill (ULTRAVISCOMILL from AIMEX) under the following conditions to disperse the carbon black and the releasing agent:

Liquid feeding speed: 1 kg/hr

Disc circumference speed: 6 m/sec

Diameter of zirconia beads: 0.5 mm

Filling factor: 80% by volume

Repeated number of dispersion treatment: 3 times

Next, 425 parts of [Polyester 2a having an anion functional group] and 100 parts of ethyl acetate are added in the container followed by one hour mixing. After 1 pass of the bead mill under the same condition mentioned above, [Pigment and releasing agent liquid dispersion 1] is obtained. Ethyl acetate is added to adjust the density of the solid portion of [Pigment and releasing agent liquid dispersion 1] to be 50%. The solid portion density thereof is measured by heating a sample of [Pigment and releasing agent liquid dispersion 1] at 130° C. for 30 minutes and then cooling it down.

Preparation of Aqueous Phase 970 parts of deionized water, 40 parts of a 25% aqueous solution of resin particulates (Copolymer of sodium salt of an adduct of sulfate with styrene-methacrylic acid-acrylic butylate-ethylene oxide methacrylate) for dispersion stability, 140 parts of a 48.5% aqueous solution of dodecyldiphenylether sodium disulfonate (EREMINOR MON-7 manufactured by Sanyo Chemical Industries, Ltd.), and 90 parts of ethyl acetate are mixed and stirred to obtain [Aqueous phase 1].

Emulsification Process 975 parts of [Pigment and releasing agent liquid dispersion 1] and is mixed for one minute by a TK HOMOMIXER (manufactured by Tokushu Kika Kogyo Co., Ltd.) at a rotation number of 5,000 rpm. Then, 88 parts of 60% ethyl acetate solution of [Polyester 1a having an amino group] is added to the TK HOMOMIXER and mixed thereby for one minute at a rotation number of 5,000 rpm. Thereafter, 1,200 parts of [Aqueous phase 1] is added to the TK HOMOMIXER and mixed thereby for 20 minutes to obtain [Emulsified slurry 1] while adjusting the rotation number of from 8,000 to 13,000 rpm.

Removal of Solvent

[Emulsion slurry 1] is set in a container equipped with a stirrer and a thermometer and the solvent is removed therefrom at 30° C. for 8 hours to obtain [Dispersion slurry 1].

Washing and Drying 100 parts of [Dispersion slurry 1] are filtered under a reduced pressure. Then, the following operations are performed.

(1) 100 parts of deionized water are added to the thus prepared filtered cake and the mixture is mixed for 10 minutes by a TK HOMOMIXER at a rotation number of 12,000 rpm and then filtered to obtain a filtered cake;

(2) 900 parts of deionized water are added to the filtered cake prepared in (1) and the resultant is mixed for 30 minutes by a TK HOMOMIXER at a rotation number of 12,000 rpm while applying ultrasonic vibration thereto, and then filtered under a reduced pressure. This operation is repeated until the electric conductivity of the reslurry liquid is not greater than 10 μC/cm;

(3) 10% hydrochloric acid is added to the reslurry liquid prepared in (2) to make pH of the reslurry liquid to be 4 followed by stirring by a three-one motor for 30 minutes and the resultant is filtered to obtain a filtered cake;

(4) 100 parts of deionized water are added to the filtered cake prepared in (3) and the resultant is mixed for 10 minutes by a TK HOMOMIXER at a rotation number of 12,000 rpm followed by filtering. This operation is repeated until the electric conductivity of the reslurry liquid is not greater than 10 μC/cm to obtain [Filtered cake 1].

[Filtered cake 1] is dried at 42° C. for 48 hours using a circulation drier. The dried cake is sieved using a screen having an opening of 75 μm to obtain [Mother toner 101]. Then, 1.8 parts of hydrophobic silica is admixed with 100 parts of [Mother toner 101] by a HENSCHEL MIXER to obtain [Toner 1] of the present invention.

The binder resins used and the toner obtained are analyzed with regard to the following physical properties and the results are shown in Tables 1, 2-1 and 2-2.

Method of Measuring Amine Value 1 g of a sample is 50 ml of dissolved in dimethylformamide and the solution is titrated by 1/100 normal solution of hydrochloric acid and methanol to calculate the total amine value using the following relationship.

$$\text{Total amine value}=0.561\times(\text{amount of drop [mg]})\times(\text{titer of dropped solution})/(\text{weight of sample [g]})$$

Method of Measuring Acid Value 1 g of a sample is dissolved in 100 ml of a liquid mixture of toluene, acetone and methanol with a mixing ratio of 75:12.5:12.5 and the solution is titrated by a solution of 1/10 normal solution of potassium hydroxide and methanol. The acid value is calculated by the following relationship.

$$\text{Acid value}=5.61\times(\text{amount of drop [mg]})\times(\text{titer of dropped solution})/(\text{weight of sample [g]})$$

Method of Measuring Hydroxyl Value 0.5 g of a sample is precisely weighed in a flask and 5 ml of acetylation reagent is correctly added thereto. Thereafter, the solution is heated by bathing the flask at a temperature from 95 to 105° C. The flask is taken out after 1 to 2 hours and then cooled down. Thereafter, water is added to the flask to resolve acetic anhydride by shaking. Then, to completely resolve the acetic anhydride, the flask is heated by bathing again for 10 minutes or longer and then cooled down. Thereafter, the wall of the flask is well washed with an organic solvent. This solution is subject to potentiometric titration with N/2 solution of potassium hydroxide and ethyl alcohol using an electrode to obtain an OH value (according to JIS K0070-1966).

Method of Measuring Molecular Weight

The molecular weight of a resin is measured by GPC (gel permeation chromatography) under the following conditions:

Device: GPC-150 (manufactured by Waters Corporation)

Column: KF801 to 807 (manufactured by Showa Denko KK)

Temperature: 40° C.

Solvent: THF (tetrahydrofuran)

Flow speed: 1.0 ml/minute

Sample: 0.1 ml of a sample having a density of from 0.05 to 0.6%.

The weight average molecular weight of the target resin is calculated using a molecular weight correction curve made by a simple dispersion polystyrene standard sample based on the molecular weight distribution of the resin measured under the conditions specified above. Showdex STANDARD (manufactured by Showa Denko K.K.) std. No. S-7300, S-210, S-390, S-875, S-1980, S-10.9, S-629, S-3.0, S-0.580 and toluene are used as the standard polystyrene sample for making the analytical curve. As the detector, an RI (refraction index) detector is used.

Particle Diameter of Toner

Specific examples of devices measuring particle size distribution of toner particles using the Coulter method include, but are not limited to, Coulter Counter TA-II and Coulter Multisizer II (both are manufactured by Beckman Coulter Inc.). The measuring method is described below.

(1) Add 0.1 to 5 ml of a surface active agent (preferably a salt of an alkyl benzene sulfide) as a dispersant to 100 to 150 ml of an electrolytic aqueous solution. The electrolytic aqueous solution is an about 1% NaCl aqueous solution prepared by using primary NaCl (e.g., ISOTON-II®, manufactured by Beckman Coulter Inc.).

(2) Add 2 to 20 mg of a measuring sample to the electrolytic aqueous solution.

(3) The electrolytic aqueous solution in which the measuring sample is suspended is subject to a dispersion treatment for 1 to 3 minutes with a supersonic disperser.

(4) Measure the volume and the number of toner particles or toner while the aperture is set to 100 μm for the measuring device mentioned above.

(5) Calculate the weight average particle diameter (D4) and the number average particle diameter (D1) of the toner from the obtained distribution.

The whole range is a particle diameter of from 2.00 to not greater than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm.

The obtained toner is evaluated according to the following and the evaluation results are shown in Tables 2-1 and 2-2.

The toner is placed in the process cartridge of ipsio CX2500 manufactured by Ricoh Co., Ltd. illustrated in FIG. 1 and the process cartridge is installed therein. A white pattern is continuously printed on 5 sheets of PPC type 6200T (manufactured by Ricoh NBS Co., Ltd.) in an environment of a temperature of 24° C. and a humidity of 45%. When the fifth sheet is observed with regard to background fouling, no background fouling is observed at all.

Next, the fixing device is removed from ipsio CX2500 and a solid image having a 3 mm margin at the front end related to the vertical direction is developed on 6 sheets of transfer paper (TYPE 6200, vertical to machine direction, manufactured by Ricoh Co., Ltd.) such that the toner density is of from 1.0 to 1.2 mg/cm$^2$. After the 6 sheets having an unfixed image thereon are output, gray scale (half tone portion) formed by dots is printed and read by a scanner (GenaScan 5000, manufactured by Dainippon screen MFG Co., Ltd.) with 1,000 dpi to obtain image data. The image data are converted into the density distribution and the granularity scale is evaluated using the following relationships (1) to (3). The result is that the granularity scale is less than 0.1 (i.e., good images are produced.)

$$\text{Granularity scale (GS)} = \exp(-1.8\langle D\rangle)\int WS(u)1/2VTF(u)du \qquad \text{Relationship (1)}$$

In the relationship (1), exp(−1.8<D>) represents a coefficient to calibrate the difference between the density and the brightness man perceives and <D> represents the average of the density.

In addition, WS can be obtained by the following relationships (2) and (3) when the density variance component having an average of 0 is f(x)dx.

$$F(u) = \int f(x)\exp(-2\int iux)dx \qquad \text{Relationship (2)}$$

$$Ws(u) = F(u)2 \qquad \text{Relationship (3)}$$

In the relationships (2) and (3), u represents space frequency.

The granularity scale has a high correlation with the subjective evaluation on smoothness of an image. An image having a small granularity is a quality and smooth image. To the contrary, an image having a large granularity is an image of poor quality. When the granularity is too large, the print quality tends to cause a practical problem.

Separately, a fixing test device, which is remodeled based on the fixing unit of an image forming apparatus (ipsio CX2500, manufactured by Ricoh Co., Ltd.) such that the fixing device has a desired value for the temperature at the fixing belt and the belt linear velocity, is used and set to have a belt linear velocity is of 125 mm/sec. and a temperature ranging from 130° C. to 155° C. with an interval of 5° C. for fixing a transfer sheet from the front end having a margin of 10 mm. Subsequent to fixing, the transfer sheet is sharply folded with the image inside, opened and lightly abraded by a cloth. The temperature required to keep the image intact is 135° C. (hereinafter, this temperature is set to be the lowest fixing temperature).

Next, the process cartridge is extracted from the apparatus and the development roller is rotated at 400 rpm for 40 minutes as the acceleration durability test. A uniform transfer surface is formed on the development roller after the acceleration durability test. Furthermore, when the regulation blade is extracted and the toner attached thereto is blown away by an air gun, no attached matter is observed, that is, no adhesion occurs to the regulation blade.

The criteria for the evaluation results are as follows:

Background Fouling

E (Excellent): no background fouling observed and no difference noticed between before and after printing G (Good): Background fouling observed in comparison with a sheet before printing but no practical problem created F (Fair): Background fouling causing a practical problem observed B (Bad): Significant background fouling causing a practical problem observed Granularity Scale E (Excellent): 0 to less than 0.1

G (Good): 0.1 to less than 0.3

F (Fair): 0.3 to less than 0.5

B (Bad): 0.5 or higher

Attachment (Fixation) on Blade

E (Excellent): No attachment on blade at all.

G (Good): Slight attachment on blade observed but no impact on printed image, creating no practical problem.

F (Fair): Matter attached to blade abraded off by finger, resulting in production of images having a white line noise, meaning that the images have practical problem.

B (Bad): Matter attached to blade not abraded off by finger, resulting in production of images having a white line noise, meaning that the images have practical problem.

Example 2

[Toner 2] is obtained in the same manner as in Example 1 except that [Polyester 1a having an amino group] is changed to [Polyester 1b having an amino group]. The evaluation results are shown in Tables 2-1 and 2-2.

Example 3

[Toner 3] is obtained in the same manner as in Example 1 except that [Polyester 1a having an amino group] is changed to [Polyester 1c having an amino group]. The evaluation results are shown in Tables 2-1 and 2-2.

Example 4

[Toner 4] is obtained in the same manner as in Example 1 except that [Polyester 2a having an anion functional group] is changed to [Polyester 2d having an anion functional group]. The evaluation results are shown in Tables 2-1 and 2-2.

Example 5

[Toner 5] is obtained in the same manner as in Example 1 except that [Polyester 1a having an amino group] is changed to [Polyester 1d having an amino group]. The evaluation results are shown in Tables 2-1 and 2-2.

Example 6

Preparation of Pigment/Releasing Agent liquid Dispersion

The following is placed and mixed in a reaction container equipped with a stirrer and a thermometer:

| | |
|---|---|
| [Polyester 2a having an anion functional group] | 265 parts |
| [Polyester 3a] | 280 parts |
| Paraffin wax | 181 parts |
| Ethyl acetate | 1,450 parts |

The mixture is agitated, heated to 80° C., and kept at 80° C. for 5 hours and then cooled down to 30° C. in 1 hour. Then, 350 parts of [Master batch 1] and 100 parts of ethyl acetate are added in the reaction container and mixed for 1 hour to obtain [Liquid material 6].

[Toner 6] is prepared in the same manner as in Example 1 except that [Liquid material 1] is changed to [Liquid material 6]. The evaluation results are shown in Tables 2-1 and 2-2.

Comparative Example 1

[Toner 7] is obtained in the same manner as in Example 1 except that [Polyester 1a having an amino group] is changed to [Polyester 2d having an anion functional group]. The evaluation results are shown in Tables 2-1 and 2-2.

Comparative Example 2

The following recipe is stirred and mixed by a HENSCHEL MIXER and mixed and kneaded by a two roll extruder. Subsequent to cooling down, the mixture is pulverized and classified such that the volume average particle diameter is from 6.5 to 7.5 μm and thus [Mother toner 102] is obtained. The temperature of the extruder is set such that the temperature of the kneaded mixture at the exit of the extruder is around 130° C.

Thereafter, [Toner 8] is obtained in the same manner as in Example 1 except that [Mother toner 101] is changed to [Mother toner 102]. The evaluation results are shown in Tables 2-1 and 2-2.

Comparative Example 3

100 parts of ethyl acetate are set in a container equipped with a condenser and a stirrer and heated to dissolve 15 parts of [Polyester 1a having an amino group] and 85 parts of [Polyester 2a having an anion functional group] set in the container in one hour while stirring. After dissolution, while gradually raising the temperature of the system, ethyl acetate is removed under a reduced pressure to obtain a resin mixture. The mixed resin is cooled down and pulverized. The pulverized resin mixture is stirred and mixed with 4 parts of polyethylene wax having a melting point of 120° C., 5 parts of C.I. Pigment blue 15:3, and 2 parts of 3,5-di-tert-butyl zinc salicylate with a HENSCHEL MIXER followed by mixing and kneading with a two roll extruder. The resultant is cooled down, pulverized and classified to obtain [Mother toner 103] having a volume average particle diameter of from 12.0 to 13.0 μm. The temperature of the extruder is set such that the temperature of the kneaded mixture at the exit of the extruder is around 130° C.

Thereafter, [Toner 9] is obtained in the same manner as in Example 1 except that [Mother toner 101] is changed to [Mother toner 103]. The evaluation results are shown in Tables 2-1 and 2-2.

Comparative Example 4

Manufacturing of Polyester Resin Latex® (1)

40 parts of [Polyester 1a having an amino group] is added to 360 parts of deionized water and heated to 90° C. Then, pH of the system is adjusted to be 7 with 5% ammonium water. While adding 0.8 parts of 10% dodecyl benzene sulfuric acid aqueous solution to the system, the system is stirred at 8,000 rpm by a homogenizer (Ultra Turrax T50, manufactured by IKA-WERKE GmbH&Co., KG) to manufacture an amorphous polyester resin latex® (1) having a volume average particle diameter (Mv) of 310 nm, measured by a dynamic scattering particle size analyzer (UPA-EX150, manufactured by Nikkiso Co., Ltd.).

Manufacturing of Polyester Resin Latex® (2)

40 parts of [Polyester 2c having an anion functional group] is added to 360 parts of deionized water and heated to 90° C. Then, pH of the system is adjusted to be 7 with 5% ammonium water. While adding 0.8 parts of 10% dodecyl benzene sulfuric acid aqueous solution to the system, the system is stirred at 8,000 rpm by a homogenizer (Ultra Turrax T50, manufactured by IKA-WERKE GmbH&Co., KG) to manufacture an amorphous polyester resin latex® (2) having a volume average particle diameter (Mv) of 260 nm, measured by a dynamic scattering particle size analyzer (UPA-EX150, manufactured by Nikkiso Co., Ltd.).

Preparation of Releasing Agent Liquid Dispersion

The following recipe is mixed, heated to 97° C. and then dispersed by a homogenizer (Ultra Turrax T50, manufactured by IKA-WERKE GmbH&Co., KG). The resultant is subject to dispersion treatment by Gaulin Homogenizer (available from Meiwa Fosis Co., Ltd.) under the following conditions (temperature: 105° C.; 550 kg/cm$^2$; 20 times) to obtain a releasing agent liquid dispersion having a volume average particle diameter (Mv) of 190 nm, measured by a dynamic scattering particle size analyzer (UPA-EX150, manufactured by Nikkiso Co., Ltd.).

| | |
|---|---|
| Paraffin wax (HNP-09, manufactured by NOF Corporation) | 100 g |
| Anion surface active agent (Neogen SC) | 5 g |
| Deionized water | 300 g |

Preparation of Cyan Pigment Liquid Dispersion

The following recipe is mixed and dissolved and then dispersed by a homogenizer (IKA Ultra Turrax) and irradiation of ultrasonic to obtain a cyan pigment liquid dispersion having a volume average particle diameter (Mv) of 150 nm, measured by a dynamic scattering particle size analyzer (UPA-EX150, manufactured by Nikkiso Co., Ltd.).

| | |
|---|---|
| Cyan pigment C.I.Pigment Blue 15:3 (copper phthalocyanine, manufactured by Dainippon ink mfg. Co., Ltd.) | 50 g |
| Anion surface active agent Neogen SC | 5 g |
| Deionized water | 200 g |

Method of Manufacturing Mother Toner

| | |
|---|---|
| Polyester resin latex ® (1) | 120 parts |
| Polyester resin latex ® (2) | 400 parts |
| Releasing agent liquid dispersion | 11 parts |
| Cyan pigment liquid dispersion | 22 parts |
| Aluminum polychloride | 0.3 parts |
| Deionized water | 800 parts |

After the recipe specified above is sufficiently mixed and dispersed in a stainless flask by a homogenizer (IKA Ultra Turrax, manufactured by IKA-WERKE GmbH&Co., KG), the flask is heated to 48° C. in an oil bath for heating to agglomerate particles. When the particle diameter is confirmed to be 5.8 μm, pH of the system is adjusted to be 6.0 by using 0.5 mol/l sodium hydroxide and then the system is heated to 94° C. while keeping stirring. While the temperature of the system is rising to 94° C., pH of the system decreases to about 5.0, which is kept for 65 minutes. Subsequent to cooling down, filtration, and washing with deionized water, the resultant is subject to solid/liquid separation treatment by separation filtration using a Buchner funnel. The resultant is re-dispersed in 3 L of deionized water at 40° C. followed by 15 minute stirring and washing. This washing operation is repeated 5 times followed by separation filtration using a Buchner funnel and a 12 hour vacuum drying to obtain [Mother toner 104]. [Toner 10] is obtained in the same manner as in Example 1 except that [Mother toner 101] is changed to [Mother toner 104]. The evaluation results are shown in Tables 2-1 and 2-2.

Comparative Example 5

[Toner 11] is obtained in the same manner as in Example 1 except that [Polyester 1a having an amino group] is changed to [Vinyl resin having an amino group] and [Polyester 2a having an amino group] is changed to [Vinyl resin having an anion functional group]. The evaluation results are shown in Tables 2-1 and 2-2.

Comparative Example 6

[Toner 12] is obtained in the same manner as in Example 1 except that [Polyester 1a having an amino group] is changed to [Polyester 3b]. The evaluation results are shown in Tables 2-1 and 2-2.

The physical properties of resins used in Examples and Comparative Examples are shown in Table 1.

TABLE 1

| | | Weight average molecular weight | Acid value (mgKOH/g) | Amine value (mgKOH/g) |
|---|---|---|---|---|
| Polyester resin I | Polyester 1a | 8,500 | 0.6 | 35.4 |
| | Polyester 1b | 6,300 | 0.4 | 16.3 |
| | Polyester 1c | 21,000 | 1.8 | 15.9 |
| | Polyester 1d | 8,300 | 1.3 | 24.2 |
| Vinyl resin having an amino group | | 18,000 | 0.2 | 19.0 |
| Polyester resin II | Polyester 2a | 6,700 | 25 | 0.1 or less |
| | Polyester 2b | 7,300 | 21 | 0.1 or less |
| | Polyester 2c | 5,800 | 17 | 0.1 or less |
| | Polyester 2d | 19,000 | 20.4 | 0.1 or less |
| Vinyl resin having an anion functional group | | 16,000 | 36 | 0.1 or less |
| Polyester resin III | Polyester 3a | 5,100 | 0.2 or less | 0.1 or less |
| | Polyester 3b | 8,500 | 33 | 30 |

The evaluation results of Examples and Comparative Examples are shown in Tables 2-1 and 2-2.

TABLES 2-1

| Toner | | Polyester resin I | Polyester resin I | Polyester resin III | | Resin for comparison |
|---|---|---|---|---|---|---|
| Toner 1 | Example 1 | Polyester 1a | Polyester 2a | — | — | — |
| Toner 2 | Example 2 | Polyester 1b | Polyester 2a | — | — | — |
| Toner 3 | Example 3 | Polyester 1c | Polyester 2a | — | — | — |
| Toner 4 | Example 4 | Polyester 1a | Polyester 2d | — | — | — |
| Toner 5 | Example 5 | Polyester 1d | Polyester 2a | — | — | — |
| Toner 6 | Example 6 | Polyester 1a | Polyester 2a | Polyester 3a | — | — |
| Toner 7 | Comparative Example 1 | — | Polyester 2a Polyester 2d | — | — | — |
| Toner 8 | Comparative Example 2 | Polyester 1a | Polyester 2a | — | — | — |
| Toner 9 | Comparative Example 3 | Polyester 1a | Polyester 2a | — | — | — |
| Toner 10 | Comparative Example 4 | Polyester resin latex ® 1 | Polyester resin latex ® 2 | — | — | — |

TABLES 2-1-continued

| Toner | | Polyester resin I | Polyester resin I | Polyester resin III | Resin for comparison | |
|---|---|---|---|---|---|---|
| Toner 11 | Comparative Example 5 | — | — | — | Vinyl resin having an amino group | Vinyl resin having an anion function group |
| Toner 12 | Comparative Example 6 | — | Polyester 2a | Polyester 3b | — | — |

TABLE 2-1

| | | Toner | Evaluation result | | | |
|---|---|---|---|---|---|---|
| | | particle diameter (μm) | Background fouling | Attachment on blade | Low temp. fixing | GS |
| Toner 1 | Example 1 | 5.3 | E | E | 140 | E |
| Toner 2 | Example 2 | 5.2 | E | E | 140 | E |
| Toner 3 | Example 3 | 5.3 | E | G | 135 | E |
| Toner 4 | Example 4 | 5.1 | E | E | 140 | E |
| Toner 5 | Example 5 | 5.2 | E | E | 145 | E |
| Toner 6 | Example 6 | 5.2 | E | G | 130 | E |
| Toner 7 | Comparative Example 1 | 5.3 | E | B | 130 | E |
| Toner 8 | Comparative Example 2 | 6.9 | E | F | 135 | G |
| Toner 9 | Comparative Example 3 | 12.5 | G | E | 155 | B |
| Toner 10 | Comparative Example 4 | 5.6 | G | F | 135 | E |
| Toner 11 | Comparative Example 5 | 5.2 | E | B | 145 | E |
| Toner 12 | Comparative Example 6 | 5.4 | E | B | 135 | E |

GS: Granularity Scale

The toner of Comparative Example 1, which does not form ion bonding, does not have a sufficient mechanical strength and thus a material attached to the blade is observed.

With regard to the pulverization toner of Comparative Example 2 manufactured by a fusing, mixing and kneading method, the polar group of the toner does not have sufficient mobility so that ion bonding is not sufficiently formed and thus a material attached to the blade is observed.

The toner of Comparative Example 3 manufactured by a fusing, mixing and kneading method after solution-mixing the binder resin is extremely strong, and a great amount of energy is required for pulverization. The obtained toner has a large particle diameter and produces poor quality images with regard to granularity scale. In addition, the low temperature fixing property is not sufficient.

With regard to the toner of Comparative Example 4 using no solvent, the polar group of the binder resin does not have a sufficient mobility so that ion bonding is not sufficiently formed and thus a material attached to the blade is observed.

With regard to the toner of Comparative Example 5 using a vinyl resin as the binder resin, the binder resin thereof is brittle and thus a material attached to the blade is observed.

With regard to the toner of Comparative Example 6, the binder resin thereof forms salts, thereby preventing cross-linking reaction so that a material attached to the blade is observed.

This document claims priority and contains subject matter related to Japanese Patent Application No. 2008-063385, filed on Mar. 12, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin comprising:

(I) a unit of a polyester resin I having an amino group at an end;

(II) another unit of a polyester resin II having an anion functional group; and a coloring agent;

wherein the polyester resin I is prepared by reacting a carboxylic residual group of a polyester with an amine compound, wherein the amine compound is at least one selected from the group consisting of aminoethanol, N-methyl-2-aminoethanol, N,N-dimethyl-2-aminoethanol, N-ethyl-2-aminoethanol, N,N-diethyl-2-aminoethanol, N-methyl-N-ethyl-2-aminoethanol, 3-amino-1-propanol, 3-methylamino-1-propanol, 3-dimethylamino-1-propanol, 1-dimethylamino-2-propanol 3-diethylamino-1-propanol, 1-diethylamino-2-propanol, and 3-dimethylamino-2,2-dimethyl-1 propanol, and wherein the toner is manufactured by (a) dissolving or dispersing the polyester resin I, the polyester resin II and the coloring agent in an organic solvent to obtain an oil phase, (b) dispersing the oil phase in an aqueous medium, (c) removing the organic solvent, and then (d) drying.

2. The toner according to claim 1, wherein the end of the polyester resin I is represented by formula (1):

$$—COX—Y_1—NR_1R_2 \quad (1),$$

wherein

X represents an oxygen atom or a sulfur atom, $Y_1$ represents a divalent organic group, $R_1$ and $R_2$ each, independently, represent a hydrogen atom or a hydrocarbon group having 1 to 8 carbon atoms, or by formula (2):

$$—CONR_3—Y_2—NR_4R_5 \quad (2),$$

wherein $Y_2$ represents a divalent organic group, and $R_3$, $R_4$, and $R_5$ each, independently, represent a hydrogen atom, or a hydrocarbon group having 1 to 8 carbon atoms.

3. The toner according to claim 1, wherein the polyester resin I has an amine value of from 12 to 40 mgKOH/g, and an acid value of from 0 to 2 mgKOH, and the polyester resin II has an amine value of from 0 to 0.2 mgKOH/g, and an acid value of from 15 to 40 mgKOH.

4. The toner according to claim 1, wherein the polyester resin I and the polyester resin II have a weight average molecular weight of from 2,000 to 30,000.

5. The toner according to claim 1, wherein a weight ratio of the polyester resin I to the polyester resin II ranges from 5:95 to 25:75.

6. The toner according to claim 1, wherein the oil phase further comprises a polyester resin III having an amine value of from 0 to 0.1 mgKOH/g, an acid value of from 0 to 2 mgKOH, and a weight average molecular weight of from 2,000 to 20,000.

7. The toner according to claim 1, wherein the toner is a single component development agent.

8. A process cartridge detachably attachable to an image forming apparatus comprising:

an image bearing member configured to bear a latent electrostatic image on a surface thereof; and a development device configured to develop the latent electrostatic image with the toner of claim 1 to obtain a visualized image, the development device comprising:

(a) a development agent container configured to accommodate a development agent comprising the toner of claim 1;

(b) a development agent bearing member configured to bear the development agent comprising the toner of claim 1 on a surface thereof and supply the toner to the surface of the image bearing member;

(c) a development agent supply member configured to supply the development agent to the surface of the development agent bearing member; and (d) a development agent regulation member configured to regulate a layer thickness of the toner of claim 1 on the development agent bearing member.

9. An image forming apparatus comprising:

(A) an image bearing member configured to bear a latent electrostatic image on a surface thereof;

(B) a charging device configured to uniformly charge the surface of the image bearing member;

(C) an irradiation device configured to irradiate the image bearing member with light according to obtained image data and write the latent electrostatic image on the surface of the image bearing member;

(D) a development device configured to develop the latent electrostatic image with the toner of claim 1 to obtain a visualized image, the development device comprising:

(d1) a development agent container configured to accommodate a development agent comprising the toner of claim 1;

(d2) a development agent bearing member configured to bear the development agent comprising the toner of claim 1 on a surface thereof and supply the toner to the surface of the image bearing member;

(d3) a development agent supply member configured to supply the development agent to the surface of the development agent bearing member; and (d4) a development agent regulation member configured to regulate a layer thickness of the toner of claim 1 on the development agent bearing member;

a transfer device configured to transfer the visualized image to a recording medium; and (E) a fixing device configured to fix the visualized image on the recording medium.

10. The toner according to claim 1, wherein the amine compound is N,N-dimethyl-2-aminoethanol.

11. The toner according to claim 1, wherein the amine compound is a first amine compound and a second amine compound, and the first amine compound reacts with the polyester resin I to give a reacted polyester resin Ia having a first amino group and the second amine compound reacts with the polyester resin I to give a reacted polyester resin Ib having a second amino group, wherein the first amino group and second amino group are different from each other in reactivity.

12. The toner according to claim 11, wherein the first amine compound is N,N-dimethyl-2-aminoethanol and the second amine compound is isophorone diamine.

13. The toner according to claim 1, wherein a weight average molecular weight of the polyster resin I having an amino group is from 4,000 to 15,000.

14. The toner according to claim 1, wherein a weight average molecular weight of the polyster resin I having an amino group is from 5,000 to 10,000.

15. The toner according to claim 1, wherein a weight ratio of the polyester resin I to the polyester resin II ranges from 8:92 to 25:75.

* * * * *